US006733960B2

(12) United States Patent
Nash et al.

(10) Patent No.: US 6,733,960 B2
(45) Date of Patent: May 11, 2004

(54) DIGITAL FILM PROCESSING SOLUTIONS AND METHOD OF DIGITAL FILM PROCESSING

(75) Inventors: Lorin C. Nash, Austin, TX (US); Douglas E. Corbin, Austin, TX (US); Kosta S. Selinidis, Austin, TX (US); Alexei L. Krasnoselsky, Austin, TX (US); Jamie M. Kropka, Austin, TX (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/073,664

(22) Filed: Feb. 11, 2002

(65) Prior Publication Data

US 2002/0164166 A1 Nov. 7, 2002

Related U.S. Application Data

(60) Provisional application No. 60/267,913, filed on Feb. 9, 2001.

(51) Int. Cl.[7] ..... G03C 5/305; G03D 5/00

(52) U.S. Cl. ..... 430/466; 430/403; 430/404; 396/604; 396/605

(58) Field of Search ..... 430/466, 403, 430/404; 396/604, 605

(56) References Cited

U.S. PATENT DOCUMENTS

| | | | | |
|---|---|---|---|---|
| 2,404,138 A | | 7/1946 | Mayer et al. | 396/604 |
| 3,520,689 A | | 7/1970 | Nagae et al. | 430/376 |
| 3,520,690 A | | 7/1970 | Nagae et al. | 430/373 |
| 3,587,435 A | | 6/1971 | Chioffe | 435/255.7 |
| 3,615,479 A | | 10/1971 | Kohler et al. | 430/30 |
| 3,615,496 A | * | 10/1971 | Kanous et al. | 430/449 |
| 3,615,498 A | | 10/1971 | Aral | 430/668 |
| 3,617,282 A | | 11/1971 | Bard | 430/379 |
| 3,747,120 A | | 7/1973 | Stemme | 346/75 |
| 3,833,161 A | | 9/1974 | Krumbein | 226/92 |
| 3,903,541 A | | 9/1975 | Von Meister et al. | 354/317 |
| 3,946,398 A | | 3/1976 | Kyser et al. | 346/1 |
| 3,959,048 A | | 5/1976 | Stanfield et al. | 156/94 |
| 4,026,756 A | | 5/1977 | Stanfield et al. | 156/554 |
| 4,081,577 A | | 3/1978 | Horner | 427/424 |
| 4,142,107 A | | 2/1979 | Hatzakis et al. | 250/571 |
| 4,215,927 A | | 8/1980 | Grant et al. | 354/317 |
| 4,249,985 A | | 2/1981 | Stanfield | 156/554 |
| 4,265,545 A | | 5/1981 | Slaker | 356/431 |
| 4,301,469 A | | 11/1981 | Modeen et al. | 358/75 |
| 4,490,729 A | | 12/1984 | Clark et al. | 346/75 |
| 4,501,480 A | | 2/1985 | Matsui et al. | 354/298 |
| 4,564,280 A | | 1/1986 | Fukuda | 354/317 |

(List continued on next page.)

FOREIGN PATENT DOCUMENTS

| | | |
|---|---|---|
| AU | 38629 | 8/1973 |
| EP | 0 261 782 A2 | 8/1987 |
| EP | 0 422 220 A1 | 3/1989 |

(List continued on next page.)

OTHER PUBLICATIONS

"*Adaptive Fourier Threshold Filtering: A Method to Reduce Noise and Incoherent Artifacts in High Resolution Cardiac Images*", Doyle, M., et al., 8306 Magnetic Resonance in Medicine 31, No. 5, Baltimore, MD, May, pp. 546–550, 1994.

(List continued on next page.)

*Primary Examiner*—Hoa Van Le
(74) *Attorney, Agent, or Firm*—Andrew J. Anderson

(57) ABSTRACT

An aqueous developer solution for use in digital film processing. The developer solution includes a developing agent and at least one surfactant or thickener. A method of processing a photographic film is also provided, and includes the steps of coating an aqueous developer solution containing at least one surfactant or thickener onto the film, thereby developing the film, and scanning the film through the coating of developer solution.

52 Claims, 7 Drawing Sheets

U.S. PATENT DOCUMENTS 4,594,598 A 6/1986 Iwagami ..... 346/140
4,621,037 A 11/1986 Kanda et al. ..... 430/30
4,623,236 A 11/1986 Stella ..... 354/318
4,633,300 A 12/1986 Sakai ..... 358/41
4,636,808 A 1/1987 Herron ..... 346/75
4,666,307 A 5/1987 Matsumoto et al. ..... 356/404
4,670,779 A 6/1987 Nagano ..... 358/75
4,736,221 A 4/1988 Shidara ..... 354/317
4,741,621 A 5/1988 Taft et al. ..... 356/376
4,745,040 A 5/1988 Levine ..... 430/21
4,755,844 A 7/1988 Tsuchiya et al. ..... 354/317
4,777,102 A 10/1988 Levine ..... 430/21
4,796,061 A 1/1989 Ikeda et al. ..... 355/73
4,814,630 A 3/1989 Lim ..... 250/578
4,821,114 A 4/1989 Gebhardt ..... 358/75
4,845,551 A 7/1989 Matsumoto ..... 358/80
4,851,311 A 7/1989 Millis et al. ..... 430/30
4,857,430 A 8/1989 Millis et al. ..... 430/30
4,875,067 A 10/1989 Kanzaki et al. ..... 354/325
4,969,045 A 11/1990 Haruki et al. ..... 358/228
4,994,918 A 2/1991 Lingemann ..... 358/214
5,027,146 A 6/1991 Manico et al. ..... 354/299
5,034,767 A 7/1991 Netz et al. ..... 354/317
5,101,286 A 3/1992 Patton ..... 358/487
5,124,216 A 6/1992 Giapis et al. ..... 430/30
5,155,596 A 10/1992 Kurtz et al. ..... 358/214
5,196,285 A 3/1993 Thomson ..... 430/30
5,200,817 A 4/1993 Birnbaum ..... 358/80
5,212,512 A 5/1993 Shiota ..... 354/319
5,231,439 A 7/1993 Takahashi et al. ..... 354/313
5,235,352 A 8/1993 Pies et al. ..... 346/140
5,255,408 A 10/1993 Blackman ..... 15/308
5,266,805 A 11/1993 Edgar ..... 250/330
5,267,030 A 11/1993 Giorgianni et al. ..... 358/527
5,292,605 A 3/1994 Thomson ..... 430/30
5,296,923 A 3/1994 Hung ..... 358/527
5,334,247 A 8/1994 Columbus et al. ..... 118/411
5,350,651 A 9/1994 Evans et al. ..... 430/21
5,350,664 A 9/1994 Simons ..... 430/362
5,357,307 A 10/1994 Glanville et al. ..... 354/324
5,360,701 A 11/1994 Elton et al. ..... 430/501
5,371,542 A 12/1994 Pauli et al. ..... 348/262
5,391,443 A 2/1995 Simons et al. ..... 430/21
5,414,779 A 5/1995 Mitch ..... 382/199
5,416,550 A 5/1995 Skye et al. ..... 354/298
5,418,119 A 5/1995 Simons ..... 430/507
5,418,597 A 5/1995 Lahcanski et al. ..... 355/76
5,432,579 A 7/1995 Tokuda ..... 354/293
5,436,738 A 7/1995 Manico ..... 358/503
5,440,365 A 8/1995 Gates et al. ..... 354/298
5,447,811 A 9/1995 Buhr et al. ..... 430/20
5,448,380 A 9/1995 Park ..... 358/520
5,452,018 A 9/1995 Capitant et al. ..... 348/651
5,465,155 A 11/1995 Edgar ..... 358/500
5,477,345 A 12/1995 Tse ..... 358/500
5,496,669 A 3/1996 Pforr et al. ..... 430/22
5,516,608 A 5/1996 Hobbs et al. ..... 430/30
5,519,510 A 5/1996 Edgar ..... 358/471
5,546,477 A 8/1996 Knowles et al. ..... 382/242
5,550,566 A 8/1996 Hodgson et al. ..... 345/202
5,552,904 A 9/1996 Ryoo et al. ..... 358/518
5,563,717 A 10/1996 Koeng et al. ..... 358/406
5,568,270 A 10/1996 Endo ..... 358/298
5,576,836 A 11/1996 Sano et al. ..... 358/302
5,581,376 A 12/1996 Harrington ..... 358/518
5,587,752 A 12/1996 Petruchik ..... 396/315
5,596,415 A 1/1997 Cosgrove et al. ..... 358/296
5,627,016 A 5/1997 Manico ..... 430/434
5,649,260 A 7/1997 Wheeler et al. ..... 396/569
5,664,253 A 9/1997 Meyers ..... 396/603
5,664,255 A 9/1997 Wen ..... 396/627
5,667,944 A 9/1997 Reem et al. ..... 430/359
5,678,116 A 10/1997 Sugimoto et al. ..... 396/611
5,691,118 A 11/1997 Haye ..... 430/357
5,695,914 A 12/1997 Simon et al. ..... 430/379
5,698,382 A 12/1997 Nakahanada et al. ..... 430/418
5,726,773 A 3/1998 Mehlo et al. ..... 358/474
5,739,897 A 4/1998 Frick et al. ..... 355/40
5,771,107 A 6/1998 Fujimoto et al. ..... 358/464
5,790,277 A 8/1998 Edgar ..... 358/487
5,835,795 A 11/1998 Craig et al. ..... 396/6
5,835,811 A 11/1998 Tsumura ..... 396/598
5,870,172 A 2/1999 Blume ..... 355/27
5,880,819 A 3/1999 Tanaka et al. ..... 355/75
5,891,608 A * 4/1999 Hashimoto et al. ..... 430/458
5,892,595 A 4/1999 Yamakawa et al. ..... 358/530
5,930,388 A 7/1999 Murakami et al. ..... 382/167
5,959,720 A 9/1999 Kwon et al. ..... 355/38
5,963,662 A 10/1999 Vachtsevanos et al. ..... 382/150
5,966,465 A 10/1999 Keith et al. ..... 382/232
5,979,011 A 11/1999 Miyawaki et al. ..... 15/308
5,982,936 A 11/1999 Tucker et al. ..... 382/233
5,982,937 A 11/1999 Accad ..... 382/239
5,982,941 A 11/1999 Loveridge et al. ..... 382/260
5,982,951 A 11/1999 Katayama et al. ..... 382/284
5,988,896 A 11/1999 Edgar ..... 396/604
5,991,444 A 11/1999 Burt et al. ..... 382/232
5,998,109 A 12/1999 Hirabayashi ..... 430/434
6,000,284 A 12/1999 Shin et al. ..... 73/150
6,005,987 A 12/1999 Nakamura et al. ..... 382/294
6,065,824 A 5/2000 Bullock et al. ..... 347/19
6,069,714 A 5/2000 Edgar ..... 358/487
6,088,084 A 7/2000 Nishio ..... 355/75
6,089,687 A 7/2000 Helterline ..... 347/7
6,101,273 A 8/2000 Matama ..... 382/169
6,102,508 A 8/2000 Cowger ..... 347/7
6,137,965 A 10/2000 Burgeios et al. ..... 396/626
6,200,738 B1 3/2001 Takano et al. ..... 430/362
6,555,300 B2 * 4/2003 Kokeguchi et al. ..... 430/403

FOREIGN PATENT DOCUMENTS

EP 0 482 790 B1 9/1991
EP 0 525 886 A3 7/1992
EP 0 580 293 A1 6/1993
EP 0 601 364 A1 6/1994
EP 0 669 753 A2 2/1995
EP 0 794 454 A2 2/1997
EP 0 768 571 A2 4/1997
EP 0 806 861 A1 11/1997
EP 0 878 777 A2 11/1998
EP 0 930 498 A2 12/1998
EP 926550 3/1999
GB 1004333 9/1965
GB 1395958 5/1975
JP 8201994 8/1996
JP 11305412 8/1999
WO WO 90/01240 2/1990
WO WO 91/09493 6/1991
WO WO 97/25652 7/1997
WO WO 98/19216 5/1998
WO WO 98/25399 6/1998
WO WO 98/31142 7/1998
WO WO 98/34157 8/1998
WO WO 98/34397 8/1998
WO WO 99/43148 8/1999 ..... H04N/1/00
WO WO 99/43149 8/1999 ..... H04N/1/100
WO WO 01/01197 1/2001 ..... G03D/5/00
WO WO 01/13174 A1 2/2001 ..... G03D/5/06
WO WO 01/45042 A1 6/2001 ..... G06T/5/00
WO WO 01/50192 A1 7/2001 ..... G03C/7/407
WO WO 01/50193 A1 7/2001 ..... G03C/7/407

| | | |
|---|---|---|
| WO | WO 01/50194 A1 | 7/2001 |
| WO | WO 01/50197 A1 | 7/2001 |
| WO | WO 01/52556 A2 | 7/2001 |

OTHER PUBLICATIONS

"*Anisotropic Spectral Magnitude Estimation Filters for Noise Reduction and Image Enhancement*", Aich, T., et al., Philips GmbH Research Laboratories, IEEE, pp. 335–338, 1996.

"*Adaptive–neighorhood filtering of images corrupted by signal–dependent noise*", Rangayyan, R., et al., Applied Optics, vol. 37, No. 20, pp. 4477–4487, Jul. 10, 1998.

"*Grayscale Characteristics*", The Nature of Color Images, Photographic Negatives, pp. 163–168.

"*Parallel Production of Oligonucleotide Arrays Using Membranes and Reagent Jet Printing*", Stimpson, D., et al., Research Reports, BioTechniques, vol. 25, No. 5, pp. 886–890, 1998.

"*Low–Cost Display Assembly and Interconnect Using InkJet Printing Technology*", Hayes, D. et al., Display Works '99, MicroFab Technologies, Inc., pp. 1–4, 1999.

"*Ink–Jet Based Fluid Microdispensing in Biochemical Applications*", Wallace, D., MicroFab Technologies, Inc., Laboratory Automation News, vol. 1, No. 5, pp. 6–9, Nov., 1996.

"*Protorealistic Ink–Jet Printing Through Dynamic Spot Size Control*", Wallace, D., Journal of Imaging Science and Technology, vol. 40, No. 5, pp. 390–395, Sep./Oct. 1996.

"*MicroJet Printing of Solder and Polymers for Multi–Chip Modules and Chip–Scale Package*", Hayes, D., et al., MicroFab Technologies, Inc.

"*A Method of Characterisstics Model of a Drop–on–Demand Ink–Jet Device Using an Integral Method Drop Formation Model*", Wallace, D., MicroFab Technologies, Inc., The American Society of Mechanical Engineers, Winter Annual Meeting, pp. 1–9, Dec. 10–15, 1989.

"*Digital Imaging Equipment White Papers*", Putting Damaged Film on ICE, www.nikonusa.com/reference/whitepapers/imaging, Nikon Corporation, Nov. 28, 2000.

* cited by examiner

DIGITAL FILM PROCESSING SOLUTIONS AND METHOD OF DIGITAL FILM PROCESSING

CROSS REFERENCE TO RELATED APPLICATIONS

This application claims benefit under 35 U.S.C. §119(e) of U.S. Provisional Application Serial No. 60/267,913, entitled Digital Film Processing Solution and Method of Digital Film Processing, which was filed on Feb. 9, 2001.

FIELD OF THE INVENTION

The present invention relates generally to digital film processing systems, and more particularly to a digital film processing solution and method of digital film processing.

BACKGROUND OF THE INVENTION

Images are used to communicate information and ideas. Images, including print pictures, film negatives, documents and the like, are often digitized to produce a digital image that can then be instantly communicated, viewed, enhanced, modified, printed or stored. The increasing use and flexibility of digital images, as well as the ability to instantly communicate digital images, has led to a rising demand for improved systems and methods for film processing and the digitization of film based images into digital images. Film based images are traditionally digitized by electronically scanning a film negative or film positive that has been conventionally developed using a wet chemical developing process.

In a traditional wet chemical developing process, the film is immersed and agitated in a series of tanks containing various processing solutions. The temperature and concentration level of the particular processing solution is strictly controlled to ensure uniformity of the development process. The film is immersed in each tank for a specific period of time.

The various processing solutions are expensive and become contaminated during the development process. These contaminated solutions form environmentally hazardous materials and various governmental regulations govern the disposal of the contaminated solutions. In addition, criminal penalties may attach to the improper disposal of the contaminated solutions. As a result, the costs associated with developing film continue to increase.

A relatively new process is digital film processing (DFP). DFP systems scan the film during the development process. DFP systems apply a thin coat of one or more film processing solutions to the film and then scan the film through the coating. Neither the processing solutions nor the silver compounds within the film are washed from the film. One problem faced by DFP systems is the properties and application of the processing solution. In particular, the processing solutions are applied to the film in an open environment instead of being immersed and agitated in tanks of processing solutions. The properties of the processing solution are a compromise between the various requirements of the DFP system. For example, a low viscosity solution would have a tendency to run-off the film and possibly contaminate the DFP system. Similarly, variations in the surface of the processing solution should be minimized to reduce variations produced during the scanning process.

SUMMARY OF THE INVENTION

One implementation of the present invention is an aqueous developer solution for use in digital film processing, comprising a developing agent and at least one surfactant or thickener. In a particular embodiment, the developer solution includes both at least one surfactant and at least one thickener. In another embodiment, the developer solution may have a surface tension of less than about 30 dynes/cm and/or a viscosity of between about 5,000 and about 30,000 cP. Suitable surfactants for use in the developer solution include, but are not limited to, fluorosurfactants. Suitable thickeners include, but are not limited to, solubilized cellulose. The developer solution may further comprise a buffered solution having a pH greater than or equal to about 8, and may include a variety of other components such as one or more activators, restrainers, preservatives, antifoggants or accelerators. In yet another embodiment, the developer solution includes both a color developing agent, as well as a developing agent which is not a color developing agent.

Another implementation of the invention is a method of processing a photographic film, comprising the steps of coating an aqueous developer solution containing at least one surfactant or thickener onto the film, thereby developing the film, and scanning the film through the coating of developer solution. The developer solution may comprise, for example, any of the embodiments described in the previous paragraph. Another embodiment of the processing method includes the step of coating at least one additional processing solution onto the film. The additional processing solution may comprise, for example, a stop solution, an inhibitor solution, an accelerator solution, a bleach solution, a fixer solution, a blix solution, and a stabilizer solution. In another embodiment, the additional processing solution may be coated onto the film prior to the scanning step. The additional processing solution may have a surface tension of less than about 30 dynes/cm, and/or a viscosity of between about 10,000 and about 30,000 cP.

Yet another implementation of the invention is a film processing system comprising: a film loader operable to received exposed film; an applicator operable to coat 100–10,000 micrometers of a developer solution onto the film, wherein the developer solution includes a developing agent and at least one surfactant or thickener; and a scanning system operable to digitize at least one image contained on the film and produce at least one digital image. The scanning system may operate to digitize at least one image contained on the film through the coating of developer solution. By way of example, the scanning system may digitize at least one image contained on the film with light within at least a portion of the visible portion of the electromagnetic spectrum and/or light within the infrared portion of the electromagnetic spectrum. The film processing system may further include a halt station operable to apply at least one additional processing solution onto the film, and the at least one additional processing solution maybe chosen from the group consisting of: a stop solution, an inhibitor solution, an accelerator solution, a bleach solution, a fixer solution, a blix solution, and a stabilizer solution.

Another embodiment of the film processing system further comprises a development station operable to control the temperature and humidity of the film after the application of the developer solution. The film processing system may also include a printer operable to print the at least one digital image, such as an ink jet type of printer. A communication system operable to communicate the at least one digital image over a network (such as the Internet) may even be includes in the film processing system. The film processing system may also include a memory device operable to store the at least one digital image, such as a CD, a DVD, a removable hard drive, or an optical disk. The film processing system may be embodied as a self-service kiosk or a photolab.

Another implementation of the invention is a method for processing film comprising the steps of: receiving an exposed film; coating 100–10,000 micrometers of a developer solution onto the film, wherein the developer solution has a viscosity between about 5,000 and about 30,000 cP; illuminating the film with light; measuring a light intensity from the film and producing sensor data; and processing the sensor data to produce at least one digital image. In one embodiment of this method, the film is illuminated through the coating of developer solution. By way of example, the light may be within at least a portion of the visible portion of the electromagnetic spectrum and/or within the infrared portion of the electromagnetic spectrum. The method may further include controlling the temperature and humidity of the film after coating the film with developer solution.

BRIEF DESCRIPTION OF THE DRAWINGS

For a more complete understanding of the invention and the advantages thereof, reference is now made to the following description taken in conjunction with the accompanying drawings, wherein like reference numerals represent like parts, in which:

FIGS. 2B-1 through 2B-4 are schematic diagrams illustrating various embodiments of a halt station shown in FIG. 2B;

FIG. 3 is a schematic diagram illustrating a scanning system shown in FIG. 1;

DETAILED DESCRIPTION OF THE INVENTION

In the following detailed description, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
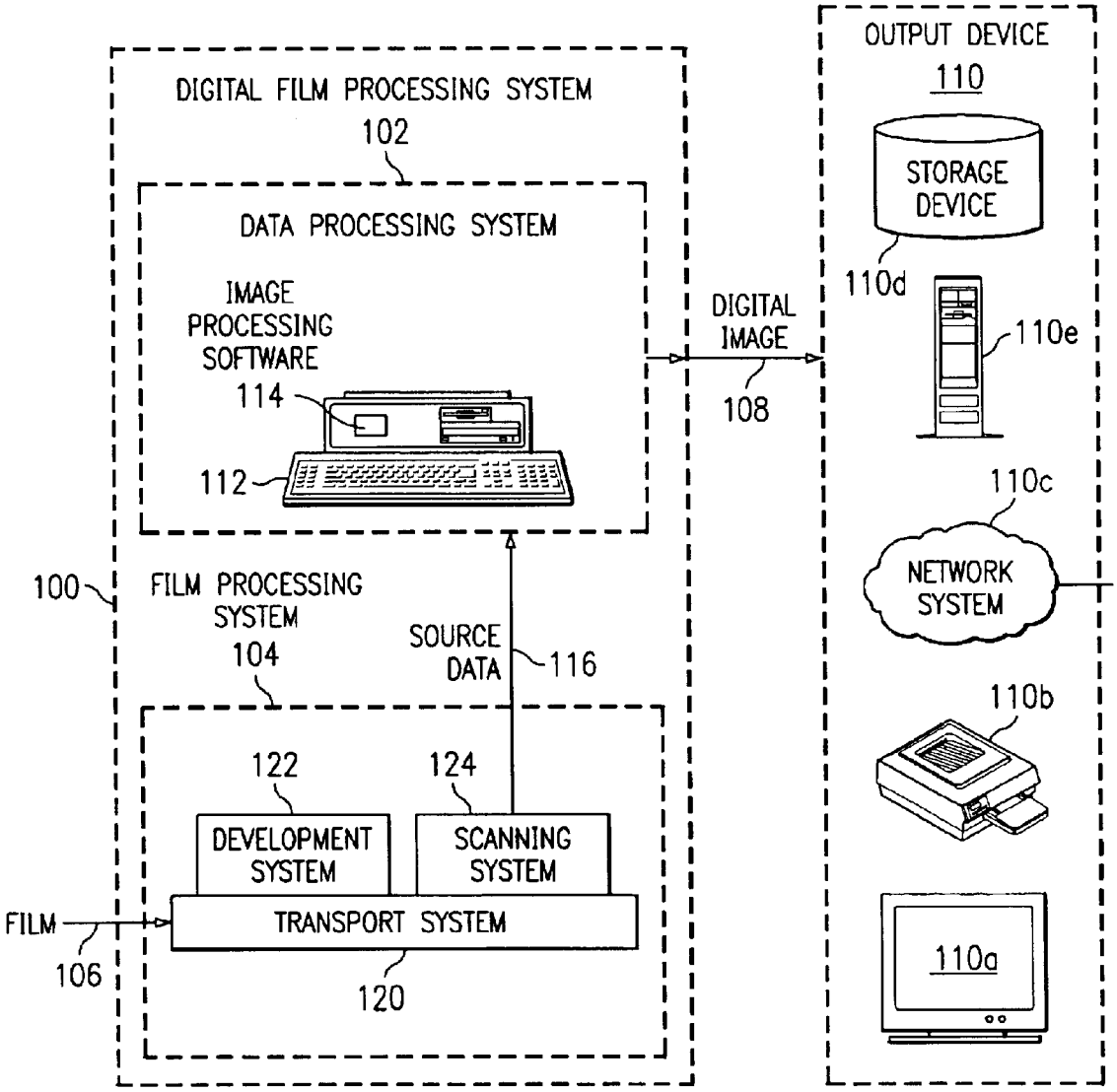
FIG. 1 is a schematic diagram of an improved digital film development system in accordance with the invention.

FIG. 1 is an example of one embodiment of a digital film development system 100. In this embodiment, the system 100 comprises a data processing system 102 and a film processing system 104 that operates to develop and digitize a film 106 to produce a digital image 108 that can be output to an output device 110. Film 106, as used herein, includes color, black and white, x-ray, infrared or any other type of film and is not meant to refer to any specific type of film or a specific manufacturer.

Data processing system 102 comprises any type of computer or processor operable to process data. For example, data processing system 102 may comprise a personal computer manufactured by Apple Computing, Inc. of Cupertino, Calif., or International Business Machines of New York. Data processing system 102 may also comprise any number of computers or individual processors, such as application specific integrated circuits (ASICs). Data processing system 102 may include an input device 112 operable to allow a user to input information into the system 100. Although input device 112 is illustrated as a keyboard, input device 112 may comprise any input device, such as a keypad, mouse, point-of-sale device, voice recognition system, memory reading device such as a flash card reader, or any other suitable data input device.

Data processing system 102 includes image processing software 114 resident on the data processing system 102. Data processing system 102 receives sensor data 116 from film processing system 104. As described in greater detail below, sensor data 116 is representative of the colors (or silver in the case of black and white film) in the film 106 at each discrete location, or pixel, of the film 106. The sensor data 116 is processed by image processing software 114 to produce the digital image 108.

The specific embodiment of the image processing software 114 is dependent upon the embodiment of the film processing system 104, and in particular, the specific embodiment of the scanning system, as described below. In an embodiment in which metallic silver grains and/or silver halide remains within the film 106, the image processing software 114 operates to compensate for the silver or silver halide in the film 106. In this embodiment, digitally compensating for the silver in the film 106 instead of chemically removing the elemental silver and/or silver halide from film 106 substantially reduces or eliminates the production of hazardous chemical effluents that are generally produced during conventional film processing methods. Although the image processing software 114 is described in terms of actual software, the image processing software 114 may be embodied as hardware, such as an ASIC. The color records for each pixel form the digital image 108, which is then communicated to one or more output devices 110.

Output device 110 may comprise any type or combination of suitable devices for displaying, storing, printing, transmitting or otherwise outputting the digital image 108. For example, as illustrated, output device 110 may comprise a monitor 110*a*, a printer 110*b*, a network system 110*c*, a mass storage device 110*d*, a computer system 110*e*, or any other suitable output device. Network system 110*c* may be any network system, such as the Internet, a local area network, and the like. Mass storage device 110*d* may be a magnetic or optical storage device, such as a floppy drive, hard drive, removable hard drive, optical drive, CD-ROM drive, and the like. Computer system 110*e* maybe used to further process or enhance the digital image 108.

As described in greater detail below, film processing system 104 operates to develop and electronically scan the developed film 106 to produce the sensor data 116. As illustrated, film processing system 104 comprises a transport system 120, a development system 122, and a scanning system 124. Transport system 120 operates to dispense and move the film 106 through the film processing system 104. In a preferred embodiment, the transport system 120 comprises a leader transport system in which a leader is spliced to the film 106 and a series of rollers pulls the film 106 through the film processing system 104, with care taken that the image surface of the film 106 is not contacted. Similar transport systems 120 are found in film products manufactured by, for example, Noritsu Koki Co. of Wakayama, Japan, and are available to those skilled in the art.

The development system 122 operates to apply one or more digital film processing solutions to the film and develop the film 106, as described in greater detail in connection with FIG. 2. One or more types of processing solutions may be used, depending upon the configuration of the development system 122. In general, a developer solution is first coated onto the film 106 to develop the film 106. The coated film 106 is transported through a developer station that controls the developing conditions of the film 106. In the case of color film, the developer chemically interacts with the chemicals within the film 106 to produce dye clouds and the metallic silver grains within the film 106. The development system 122 may also apply other suitable film processing solutions, such as a stop solution, inhibitors, accelerators, bleach solution, fixer solution, blix solution (combines the functionality of a bleach solution and a fixer solution), stabilizer solution and the like. In a preferred embodiment, one of the digital film processing solutions comprises a viscous developer solution, as described below, that produces the metallic silver grains and the magenta, cyan and yellow dye images within the film 106.

The scanning system 124 scans the film 106 through the processing solutions applied to the film 106, as described in greater detail in connection with FIG. 3. In other words, the processing solutions are not necessarily removed from the film 106 prior to the scanning process. In contrast, conventional film processing systems remove the elemental silver and silver halide from the film, as well as the processing solutions, to create a conventional film image prior to any digitization process.

The scanning system 124 may be configured to scan the film 106 using any form or combination of electromagnetic energy, referred to generically herein as light. In the preferred embodiment, the film 106 is scanned with light within the visible portion of the electromagnetic spectrum. A disadvantage of scanning with visible light is that any remaining silver halide within the film 106 will react with the light and fog the film 106. The visible light allows the density of the colored dye clouds to be measured, as well as any silver halide and/or elemental silver remaining in the film 106. In particular, one or more wavelength bands of visible light may be used to scan the film 106. For example, the film 106 may be scanned using visible light within the red, green and/or blue portions of the electromagnetic radiation spectrum. The film 106 may also be scanned using infrared light. The dye clouds within the film 106 are generally transparent to infrared light, but any elemental silver and/or silver halide is not transparent to infrared light. In addition, infrared light does not substantially fog the film. As a result, the infrared light allows the density of any remaining elemental silver and/or silver halide within the film 106 to be measured without damaging the film 106. In at least one embodiment, a satisfactory digital image 108 has been obtained by scanning the film 106 solely with infrared light. In an embodiment in which visible light and infrared light is used, the infrared light allows any elemental silver and/or silver halide to be compensated for by the image processing software 114. In contrast, conventional film processing systems remove substantially all of the silver, both silver halide and elemental silver, from the film prior to drying the film and conventionally scanning the film.

In operation, exposed, but undeveloped film 106 is fed into the transport system 120. The film 106 is transported through the development system 122. The development system 122 applies a processing solution to the film 106 that develops the film 106. The transport system 120 moves the film 106 through the scanning system 124. The scanning system 124 scans the film 106 and produces sensor data 116. The sensor data 116 represents the images on the film 106 at each pixel. The sensor data 116 is communicated to data processing system 102. The data processing system 102 processes the sensor data 116 using image processing software 114 to produce the digital image 108. The data processing system 102 may also operate to enhance or otherwise modify the digital image 108. For example, the digital image 108 maybe modified in accordance with input from the user. The data processing system 102 communicates the digital image 108 to the output device 110 for viewing, storage, printing, communicating, or any combination of the above.

In a particular embodiment of the digital film development system 100 the system 100 is configured as a self-service film processing system, such as a kiosk. Such a self-service film processing system is uniquely suited to new locations because no plumbing is required to operate the self-service film processing system. In addition, the developed images 108 can be prescreened by the user before they are printed, thereby reducing costs and improving user satisfaction. The self-service film processing system can also be packaged in a relatively small size to reduce the amount of floor space required. As a result of these advantages, a self-service film processing system can be located in hotels, college dormitories, airports, copy centers, or any other suitable location. In other embodiments, the system 100 may be used for commercial film lab processing applications. Again, because there is no plumbing and the environmental impact of processing the film 106 is substantially reduced or eliminated, the installation cost and the legal liability for operating such a film lab is reduced. The system 100 can be adapted to any suitable application without departing from the scope and spirit of the invention.

Figure 2A:
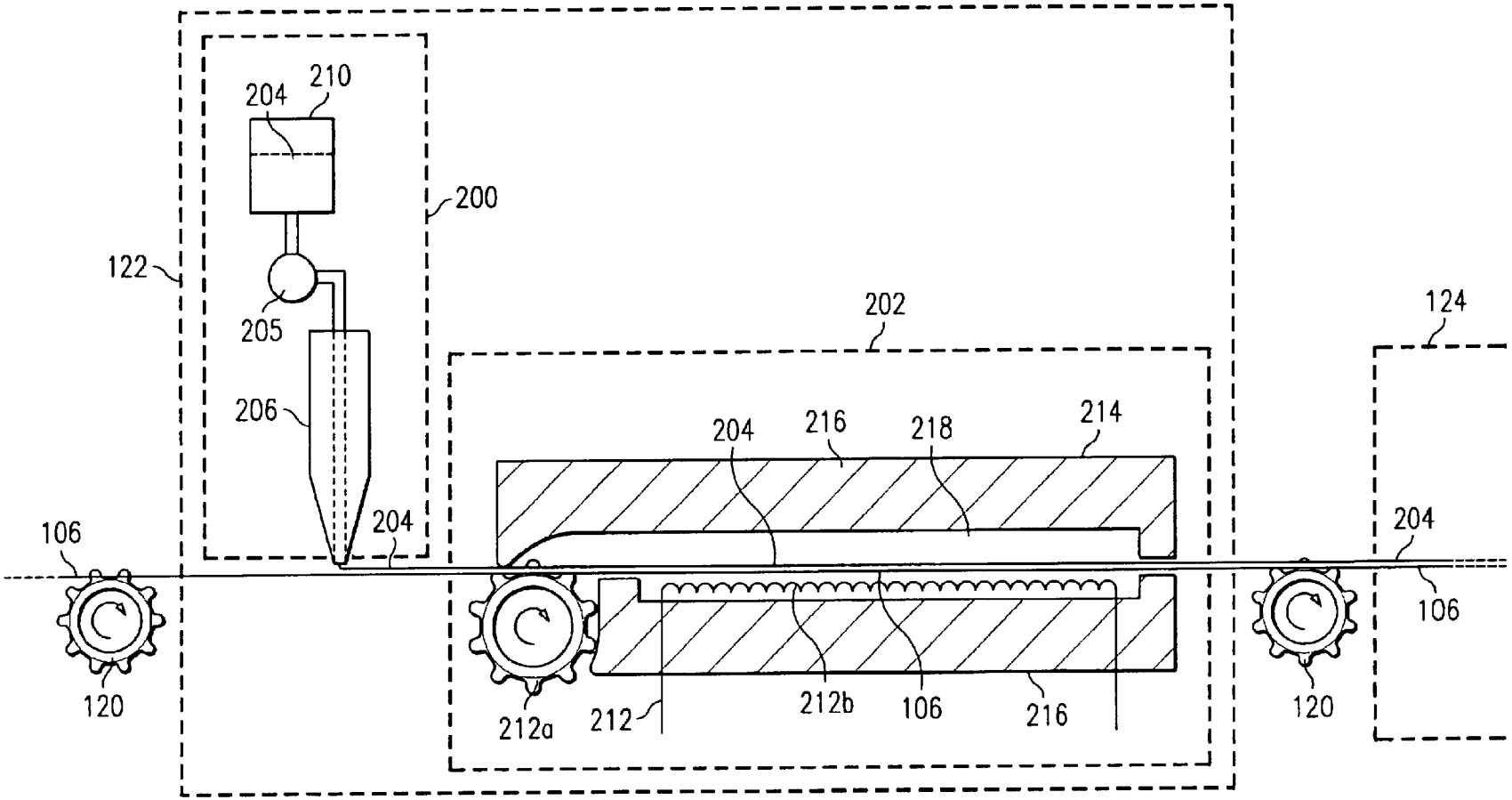
FIG. 2A is a schematic diagram illustrating one embodiment of a development system shown in FIG. 1.

FIG. 2A illustrates one embodiment of the development system 122. In this preferred embodiment, a development system 122*a* comprises an applicator station 200 and a development station 202. The applicator station 200 operates to coat a processing solution (or developer solution) 204 onto the film 106. The processing solution 204 includes one or more developing agents.

A developing agent is any component (or group of components) capable of reducing an exposed emulsion grain (silver halide crystal) to metallic silver. The developing agent(s) interacts with latent image centers, which are elemental silver, to produce visible silver grains. In the case of color developing agents used on color film, the by-product of this chemical reaction then reacts with one or more dye precursors (couplers) in the emulsion layers of the film 106 to produce the appropriate dye clouds.

Any of a wide variety of developing agents may be employed in developer solution 204. In fact, developer solution 204 may comprise a conventional color developer solution, such as Flexicolor Developer for Process C-41 available from the Eastman Kodak Company, that has been suitably modified (particularly as to its viscosity and surface tension) as described further herein. Suitable developing agents include, but are not limited to:

various aminophenols, such as:
- p-methylaminophenol sulfate
- N-methyl-p-aminophenol
- diaminophenol various 3-pyrazolidones, such as:
- 1-phenyl-3-pyrazolidone
- 1-phenyl-4,4-dimethyl-3-pyrazolidone
- 4-hydroxymethyl-4-methyl-1-phenyl-3-pyrazolidone various dihydroxybenzenes, such as:
- hydroquinone
- 2-chloro-hydroquinone
- o-dihydroxybenzene various phenylenediamines (including salts thereof), such as:
- N,N-diethyl-p-phenylenediamine sulfate
- 4-Amino-3-methyl-N-ethyl-N-(β-hydroxyethyl)-aniline sulfate;
- 2-Amino-5-diethylaminotoluene Monohydrochloride; and
- 4-Amino-3-methyl-N-ethyl-N-(β-methanesulfonamidoethyl)-m-toluidine sesquisulfate monohydrate.

The phenylenediamines are color developing agents in that they not only reduce exposed silver halide grains to metallic silver, the by-product of this reaction will react with one or more dye precursors in the film to form a dye image. The above list of suitable developing agents is not exhaustive, and is merely intended to identify exemplary developing agents. Suitable developing agents include any compound or combination of compounds capable of reducing an exposed emulsion grain (silver halide crystal) to metallic silver, including, but not limited to, compounds used as developing agents in conventional black and white and color film development. The developer solution may include multiple developing agents, such as a color developing agent and a developing agent which is not capable of reacting with couplers in the film to form dye clouds.

The concentration of developing agent(s) in the developer solution can vary widely depending upon the particular developing agent(s) employed, the type of film being developed, and processing conditions (such as temperature). However, the amount of developing agent(s) should be sufficient to provide adequate development activity prior to scanning. In addition, the amount of developing agent(s) should not be so high that the developer solution crystallizes or the film fogs or overdevelops Most developing agents require a source of alkalinity, and the level of alkali in the developer solution of the present should also be stabilized. Therefore, the developer solution should generally comprise a buffered solution having a pH greater than or equal to about 8. In most instances, an alkali (activator) should be included in order to provide a source of alkalinity. A buffer may also be included, however, some activators also act as buffers. Suitable activators include sodium hydroxide, potassium hydroxide, potassium carbonate, sodium carbonate and sodium tetraborate. Of course any source of alkali which does not otherwise interfere with film development or scanning may be used as an activator. The amount of alkali will depend, in part, on the particular developing agent(s) employed. The alkali concentration should not be so high as to cause fogging, and should be sufficient to ensure proper development (i.e., too little activator may result in slow, weak development). As for buffers, sodium carbonate and sodium tetraborate not only provide alkali but also act as buffers, and therefore a separate buffer may not be necessary when either of these compounds is used as an activator. Another suitable buffer is potassium phosphate (tribasic). Likewise, any buffer which does not interfere with film development may be used in order to stabilize the alkali level, as necessary. It should be noted that some developing agents (notably, diaminophenol) may not require an activator or buffer.

The developer solution may also include one or more preservatives in order to prevent oxidation of the developing agent, thereby prolonging the useful life of the developer solution and preventing staining of the film. Suitable preservatives include sodium sulfite, potassium sulfite, hydroxylamine sulfate and sodium ascorbate (which can also serve as a developing agent). The amount of preservative should be chosen to adequately prevent oxidation of the developing agent while not interfering with the development process.

Developer solution 204 may further include one or more restrainers. Restrainers act to balance the activity of the developing agent, thereby controlling both the development of the film as well as the development of fog. Suitable restrainers include sodium bromide and potassium bromide. In order to further control fog formation, the digital film processing solution may include one or more antifoggants. Suitable antifoggants include:

- Benzotriazole
- 5-Methyl-benzotriazole
- 1-Phenyl-5-mercaptotetrazole
- 6-Nitrobenzimidazole Nitrate
- 5-Nitroindazole
- 5-Nitrobezimidazole
- 3-Methylbenzothiazolium p-toluenesulfonate
- 2-Benzimidazolethiol
- 3,5-Dinitrobenzoic acid.

The amount of restrainer and antifoggant should be chosen to adequately prevent fog formation while not excessively retarding development of the image.

Developer solution 204 may also include other additives typically used in film developers. Examples include accelerators which increase the rate of development (such as triethanolamine, sodium thiocyanate or laurylpyridinium chloride). A variety of other additives may further be included in order to provide any of a variety of properties. These additional additives may include one or more organic solvents, image tone modifiers, auxiliary antioxidants, water softeners (sequestering agents), dye couplers, competing couplers, auxiliary developing agents, color dyes, fragrances, hardeners, dichroic fog reducers, and the like.

Any substantial unevenness in the layer of developer solution 204 on the film can adversely affect the scanning process. For example, if a conventional film processing solution were employed in the methods and systems of the present invention, edge beads would typically form on the film and the processing solution may even pull itself into the center portions of the film 106. The applicants have found that a more even layer of the developer solution 204 will be formed if the surface tension of the developer solution 204 is less than about 30 dynes/cm (measured at 25° C.). In particular, optimal results are obtained when the surface tension of the developer solution 204 is less than about 25 dynes/cm, more preferably less than about 22 dynes/cm. Although specific surface tension measurements are provided, these values should not be considered as exact values and can vary within the spirit and scope of the invention.

One method for reducing the surface tension is to add one or more surfactants to the processing solution. Surfactants are wetting agents that reduce surface tension and allow for uniform wetting of the surface of the film. While any of a variety of surfactants may be used, the preferred embodiments of the processing solutions of the present invention utilize fluorosurfactants, particularly fluorosurfactants which do not interfere with the other properties of the processing solution (such as the speed of film development). Suitable fluorosurfactants may be partially or fully fluorinated, and are commercially available from a number of sources. Typically, commercially available surfactants are provided as a mixture of water, one or more surfactants, and one or more optional ingredients (such as a solvent). In addition, the specific structures of the surfactants in commercially-available surfactant solutions are proprietary. Therefore, the surfactant(s) in the processing solutions of the present invention may be provided by using one or more commercially-available surfactant solutions which provide the desired surface tension and do not interfere with the other properties of the processing solution. Suitable commercially-available surfactant solutions (and their publicly-available compositions) include, but are not limited to:

| | |
|---|---|
| DuPont Zonyl FSO | |
| Telomer B Monoether with Polyethylene Glycol | 50% |
| Ethylene Glycol | 25% |
| Water | 25% |
| 1,4-Dioxane | <0.1% |
| DuPont Zonyl FS-300 | |
| Fluoroalkyl Alcohol Substituted Polyethylene Glycol | 40% |
| Water | 60% |
| 1,4-Dioxane | <0.1% |
| 3M Fluorad Fluorochemical Surfactant FC-129 | |
| Water | 32% |
| 2-Butoxyethanol | 14% |
| Ethanol | 4% |
| Potassium Fluoroalkyl Carboxylate (C8) | 42% approx |
| Potassium Fluoroalkyl Carboxylate (C7) | 3.0% approx |
| Potassium Fluoroalkyl Carboxylate (C6) | 3.0% approx |
| Potassium Fluoroalkyl Carboxylate (C5) | 3.0% approx |
| Potassium Fluoroalkyl Carboxylate (C4) | 3.0% approx |
| Kodak Photo Flo 200 | |
| Water | 60–70% |
| Propylene Glycol | 25–30% |
| p-tert-Octylphenoxypolyethoxyethyl Alcohol | 5–10% |

It should be noted that Kodak Photo Flo 200 does not include a fluorosurfactant. It should also be kept in mind that the surface tension is dependent upon not only the amount of surfactant in the processing solution, but also the type and amounts of other components in the processing. Accordingly, the amount of surfactant(s) needed to achieve the desired surface tension will vary depending upon the composition of the particular processing solution.

In the system of the present invention, the film is not developed while immersed in a tank of solution. Rather, the processing solution is applied to the film, and the film is then scanned through the layer of processing solution, either wet or dry. Therefore, the processing solution should be applied to the film, and remain thereon, in a uniform manner. The thickness of the developer solution 204 as applied onto the film 106 should generally be greater than about 100 micrometers. A coating thickness which is too great may result in a tendency for the processing solution to run off the film 106. Therefore, the thickness of the developer solution 204 as applied onto the film 106 may be between about 100 and about 1000 micrometers, more preferably between about 150 and about 400 micrometers, and most preferably about 250 micrometers.

As further described herein, the developer solution 204 of the present invention (as well as the other processing solutions described herein) may be applied to the film in a variety of ways. For example, the developer solution 204 may be applied to the film using an applicator which operates to coat the film with a thin even layer of developer solution. One particular type of applicator which may be used is a slot coater. In order to facilitate coating the film using a slot coater or similar types of applicators, and to ensure a thin, even layer of developer solution on the film, a viscous developer solution may be employed. The term "viscous" simply means that the viscosity of the developer solution is greater than the viscosity of a developer solution formulated for conventional film processing using comparable developer solution components.

In general, one or more thickeners are needed in order to achieve the desired viscosity. In one embodiment, the viscosity of the processing solution may be about 5,000 to about 30,000 cP (measured at 45±4° C.), more preferably between about 10,000 and about 20,000 cP, most preferably about 16,000 cP. It should be pointed out that the processing solutions of the present invention having one or more of the thickeners described herein will typically be a non-Newtonian fluid. Therefore, viscosity measurements will depend greatly on the testing apparatus and methods, particularly the shear rate used during testing The viscosity measurements reported herein may be measured using a Brookfield LVDV-E viscometer, and a shear rate of approximately 0.84 $sec^{-1}$. The use of other equipment and/or other methods, however, may result in a wide variation in measured viscosity. Therefore, the above viscosity ranges are intended to approximate suitable values.

As used herein, the term thickener refers to any component or components which provide the desired viscosity for the developer solution, and do not otherwise interfere with development of the film or scanning. Therefore, the thickener(s) employed should be chosen to ensure that the processing solution remains substantially optically clear during use (i.e., at the temperature during scanning). Particularly suitable thickeners include polyvinyl alcohol (PVA), and solubilized cellulose, such as carboxymethylcellulose or hydroxyethylcellulose.

The following provides one example of a developer solution 204 suitable for use with color film in accordance with one embodiment of the present invention:

| | |
|---|---|
| Water | 500 ml |
| Potassium carbonate, anhyd. | 20.0 g |
| Sodium sulfite, anhyd. | 4.25 g |
| Potassium bromide | 6.0 g |
| 4-hydroxymethyl-4-methyl-1-phenyl-3-pyrazolidone | 0.12 g |
| 4-Amino-3-methyl-N-ethyl-N-(β-hydroxyethyl)-aniline sulfate | 9.5 g |
| DuPont FSO Fluorosurfactant, 50% active solution | 0.2 ml |
| Potassium hydroxide, as needed to provide a pH of approx. 10.4 at 22.0° C. | |
| 2-Hydroxyethyl cellulose (MW $1.3 \times 10^6$) | 14.5 g |
| Water to make 1000 ml | |

The surface tension of this developer solution was approximately 20 dynes/cm, and its viscosity was approximately 18,000 cP (as measured in the manner described previously). The above example is not intended to limit in any way the scope of the present invention, and merely provides one suitable example of a developer solution in accordance with the present invention.

As further described herein, in addition to the developer solution 204 described above, the development system 122 may also apply other film processing solutions, such as a stop solution, inhibitor solution, accelerator solution, bleach solution, fixer solution, blix solution (combines the functionality of a bleach solution and a fixer solution), stabilizer solution and the like. These additional solutions may be formulated similar to conventional film processing solutions, however, the surface tension and viscosity should be modified in the manner described previously with respect to the developer solution (i.e., by the addition of one or more surfactants and one or more thickeners).

By way of example, a stop solution comprising a dilute, acidic, aqueous solution may be employed in order to neutralize any alkali remaining on the film, thereby halting development of the film. Typically, stop solutions employ a combination of sodium acetate and acetic acid, however, sodium bisulfite, citric acid, and/or sodium acid sulfate may be employed in various combinations well-known to those skilled in the art. A stop solution used in the present invention, however, may also include one or more surfactants and one or more thickeners, such that the stop solution has the surface tension and viscosity specified above with respect to the developer solution. One exemplary stop solution is as follows:

| | |
|---|---|
| Water | 700 ml |
| Sodium Acetate | 139.0 g |
| Acetic Acid, glacial | 100.0 ml |
| DuPont FSO Fluorosurfactant, 50% active solution | 0.2 ml |
| 2-Hydroxyethyl cellulose (MW 1.3 × $10^6$) | 15 g |
| Water to make | 1000 ml |

By way of further example, another suitable processing solution which may be employed in the present invention is a fixer. After development, the film remains sensitive to light, since it contains undeveloped silver halide. Therefore, a fixer solution may be employed to remove the undeveloped silver halide. Typically, fixer solutions include one or more fixing agents which act to dissolve undeveloped silver halide, such as sodium or potassium thiocyanate or ammonium thiosulfate. Fixer solutions may also include acetic acid and/or sodium acetate, or similar functional compounds, in order to control the acidity of the fixer solution. A fixer solution used in the present invention, however, may also include one or more surfactants and one or more thickeners, such that the fixer solution has the surface tension and viscosity specified above with respect to the developer solution. Two exemplary fixer solutions are as follows:

| Fixer #1 | |
|---|---|
| Water | 500 ml |
| Potassium Thiocyanate | 550.0 g |
| Sodium Acetate | 55.6 g |
| Ethyl Alcohol | 180 ml |
| DuPont FSO Fluorosurfactant, 50% active solution | 0.2 ml |
| 2-Hydroxyethyl cellulose (MW 1.3 × $10^6$) | 15 g |
| Water to make | 1000 ml |
| **Fixer #2** | |
| Water | 500 ml |
| Ammonium Thiosulfate, dry | 194.3 g |
| DuPont FSO Fluorosurfactant, 50% active solution | 0.2 ml |
| 2-Hydroxyethyl cellulose (MW 1.3 × $10^6$) | 15 g |
| Water to make | 1000 ml |

Yet another suitable processing solution which may be employed in the present invention is a bleach solution. After development of color film, the developed silver grains remain in the film along with the dye clouds. As with conventional color film development, it may be desirable to fully or partially oxidize the developed silver to improve the light transmission of the film. A bleach solution includes one or more bleaching agents which convert the developed silver into silver salts which may later be removed using a fixer solution. Typical bleach solutions employ strong oxidizers such as Potassium Ferricyanide, Potassium Permanganate, Ferric Ammonium Ethylenediaminetetraacetic Acid, Ferric Ammonium Propylenediaminetetraacetic Acid, or Cupric Sulfate, and may optionally include one or more additional components (such as acetic acid) in order to adjust the pH of the bleach solution. A bleach solution used in the present invention, however, may also include one or more surfactants and one or more thickeners, such that the bleach solution has the surface tension and viscosity specified above with respect to the developer solution. An exemplary bleach solution is as follows:

| | |
|---|---|
| Water | 500 ml |
| Ammonium Bromide | 250.0 g |
| Ferric Ammonium EDTA | 160.0 g |
| Diammonium EDTA | 9.0 g |
| Acetic Acid, glacial | 12.0 ml |
| DuPont FSO Fluorosurfactant, 50% active solution | 0.2 ml |
| 2-Hydroxyethyl cellulose (MW 1.3 × $10^6$) | 15 g |
| Water to make | 1000 ml |

As is known to those skilled in the art, a combined fixer and bleach solution (often referred to as a "blix" solution) may also be employed. In this manner, a separate fixer solution need not be applied to the film after the bleach solution if it is desirable to remove the insoluble silver salts resulting from the bleach step. Such a blix solution may comprise a combination of the components of a fixer and bleach solution. A blix solution used in the present invention, however, may also include one or more surfactants and one or more thickeners, such that the blix solution has the surface tension and viscosity specified above with respect to the developer solution. An exemplary blix solution is as follows:

| | |
|---|---|
| Water | 500 ml |
| Ferric Ammonium EDTA | 194 g |
| Diammonium EDTA | 11.0 g |
| Ammonium Thiosulfate, 60% solution | 350 ml |
| Ammonium Sulfite, monohyd. | 40.0 g |
| DuPont FSO Fluorosurfactant, 50% active solution | 0.2 ml |
| 2-Hydroxyethyl cellulose (MW 1.3 × $10^6$) | 15 g |
| Water to make | 1000 ml |

Referring again to FIG. 2A, the applicator station 200 generally includes an applicator 206, a fluid delivery system 208, and a reservoir 210. The applicator 206 operates to coat the film 106 with a thin even layer of processing solution 204. The preferred embodiment of the applicator 206 comprises a slot coater device. In alternative embodiments, the applicator 206 comprises an ink jet applicator, a tank, an aerosol applicator, drip applicator, or any other suitable device for applying the processing solution 204 to the film 106. The fluid delivery system 208 delivers the processing solution 204 from the reservoir 210 to the applicator 206. In an embodiment in which the applicator 206 comprises a slot coater device, the fluid delivery system 208 generally delivers the processing solution 204 at a constant volumetric flow rate to help insure uniformity of coating of processing solution 204 on the film 106.

The reservoir 210 may contain a sufficient volume of processing solution 204 to process multiple rolls of film 106. As described in greater detail below, the reservoir 210 maybe refillable or replaceable within the development system 122, and may comprise a closed system that substantially prevents air and other contaminates from contacting the digital film processing solution 204. In one embodiment, the reservoir 210 comprises a replaceable cartridge. In other embodiments, the reservoir 210 comprises a refillable tank. The applicator station 200 may comprise other suitable systems and devices for applying the processing solution 204 to the film 106. For example, the applicator station 200 may comprise a tank filled with processing solution 204 in which the film 106 is transported through the tank, effectively dipping the film 106 into the processing solution 204. In yet another embodiment, the reservoir 210 may comprise a flexible bladder that collapses as the digital film processing solution 204 is dispensed. In this manner, air is not introduced into the reservoir 210 and the digital film processing solution 204 is not contaminated by the air or other contaminates.

The development station 202 operates to develop the coated film within a controlled air environment. As used herein, air refers generally to a gaseous environment, which may include a nitrogen environment or any other suitable gaseous environment. It has been discovered that in an air environment, the temperature of the developing film 106 strongly affects the development of the film 106. If the temperature is not controlled, the may develop unevenly and the resulting image will be overdeveloped in areas where the temperature was highest and underdeveloped in areas where the temperature was coolest. Testing has also shown that the humidity surrounding the film 106 affects the development of the film 106. This is believed to be due to the cooling effect of the processing solution evaporating from the film 106, thereby causing unpredictable and uneven temperature gradients across the film 106. Again, conventional development stations do not control the humidity surrounding the film during development.

In one embodiment of the present invention, the development station 202 includes a heating system 212. The heating system 212 operates to heat, or maintain the temperature of, the film 106. In a preferred embodiment wherein a heater is employed, the film 106 is heated and/or maintained at a temperature within the range of 40–80 degrees Centigrade. In the preferred embodiment, the coated film 106 is heated and/or maintained at a temperature within the range of 45–55 degrees Centigrade, and more preferably at approximately 50 degrees Centigrade. The specific temperature is not as important as consistently maintaining a repeatable temperature profile during the development process. In one embodiment, the temperature is maintained within profile by +/−5 degrees Centigrade. In a preferred embodiment, the temperature is maintained within profile by +/−1 degree Centigrade, and more preferably within +/−0.2 degrees Centigrade. It should be understood that the temperature and temperature profile may comprise any suitable temperature and temperature profile without departing from the scope of the present invention.

In a particular embodiment, the heating system 212 includes multiple individual heating elements that allow the temperature of the heating system 212 to be varied during development. In this embodiment, the temperature of the developing film 106 can be varied to optimize the development of the film 106. For example, infrared light and sensors may be used to monitor the development of the film 106. Based on the sensor readings, the heating system 212 can increase or decrease the temperature of the developing film 106 to compensate for the effects of temperature, type of film, film manufacturer, or other processing variable.

In one embodiment, the heating system 212 contacts the film 106 on the side opposite the coating of processing solution 204. Because of the physical contact between the film 106 and the heating system 212, i.e., conductive heat transfer, the film 106 can be efficiently heated so that evaporation, or humidity, will not substantially effect the processing of the film 106. As a result, a housing forming a development tunnel, as described in greater detail below, is not required, but may be used to further control the development process. In a particular embodiment, the heating system 212 includes a heated roller 212*a* and a heating element 212*b*. In the embodiment illustrated, the heated roller 212*a* heats the film 106 as the processing solution 204 is applied to the film 106 and the heating element 212*b* maintains the temperature of the coated film 106 during development.

In another embodiment, the development station 202 includes a development tunnel 214. The development tunnel 214 comprises a housing 216 that forms a development chamber 218 through which the coated film 106 is transported. The development chamber 218 preferably forms a minimum volume surrounding the coated film 106. The development tunnel 214 is preferably shaped and disposed such that air circulation through the development chamber 218 is minimized. In particular, the development chamber 218 is preferably oriented horizontally to reduce chimney effects, i.e., hot air rising. In addition, the housing forms an entry and exit having in the development chamber 218 having a minimum cross section to reduce circulation of air through the development chamber 218.

In a preferred embodiment, the housing 216 is insulated. As a result, the development tunnel 214 does not necessarily require a heating system 212. However, in a preferred embodiment, the development tunnel 214 includes a heating system 212 to heat and/or maintain the temperature of the coated film 106. In this embodiment, the heating system 212 does not necessarily contact the coated film 106 within the development tunnel 214. For example, the heating system 212 may comprise a heating element 212*b* located within the development tunnel 214 to heat and/or maintain the temperature of the film 106. The heating system 212 may also comprise a forced air heating system that forces heated air through the development tunnel 214.

The humidity surrounding the coated film 106 may also be controlled. As discussed above, evaporation of the processing solution 204 from the film 106 can negatively effect the consistent development or processing of the film 106. In one embodiment, the humidity is maintained within a range of 80 to 100 percent humidity, and preferably within a range of 95 to 100 percent humidity, and more preferably at approximately 100 percent humidity. The humidity is preferably controlled within the development chamber 218. The minimum volume of the development chamber 218 facilitates controlling the humidity. As discussed above, one embodiment of the transport system 120 comprises a leader transport system. In this embodiment, the processing solution 204 can be applied to the film leader. This allows the evaporation of the processing solution 204 on the film leader to saturate and stabilize the humidity within the development chamber 218. In another embodiment, the humidity is controlled by a humidification system 220. In a particular embodiment, the humidification system 220 comprises a wicking system that uses a water reservoir to supply humidity to the development chamber 218. The humidification system 220 may comprise other suitable devices or systems for supplying humidity to the development chamber 218. For example, the humidification system 220 may comprise a jet that injects an atomized spray of water into the development chamber 218. The humidification system 220 may also operate to reduce the humidity within the development chamber 218. Too much humidity within the development chamber 218 can result in pooling of water within the development chamber 218, which can negatively affect development and scanning of the film 106.

The development station 202 may also include a control system to monitor and control the temperature and humidity within the development chamber 214. The development station 202 is also light sealed to prevent external light and light from the scanning station 204 from exposing the film 106. The development station 202 may include other suitable devices and systems without departing from the scope of the present invention. For example, the development station 202 is described in terms of a developer solution, but it is also applicable to other processing solutions, such as a fix solution, bleach solution, blix solution, halt solution, and the like.

In operation, transport system 120 transports the film 106 through the applicator station 200. Fluid delivery system 208 dispenses the processing solution 204 from the reservoir 210 through the applicator 206 onto the film 106. The processing solution 204 develops the film 106. The coated film 106 is then transported through the development tunnel 214 of the development station 202. The development tunnel 214 operates to give the film 106 time to develop within a controlled temperature and humidity environment within the development chamber 218. Upon development, the coated film 106 is transported by the transport system 120 to the scanning system 124.

Figure 2B:
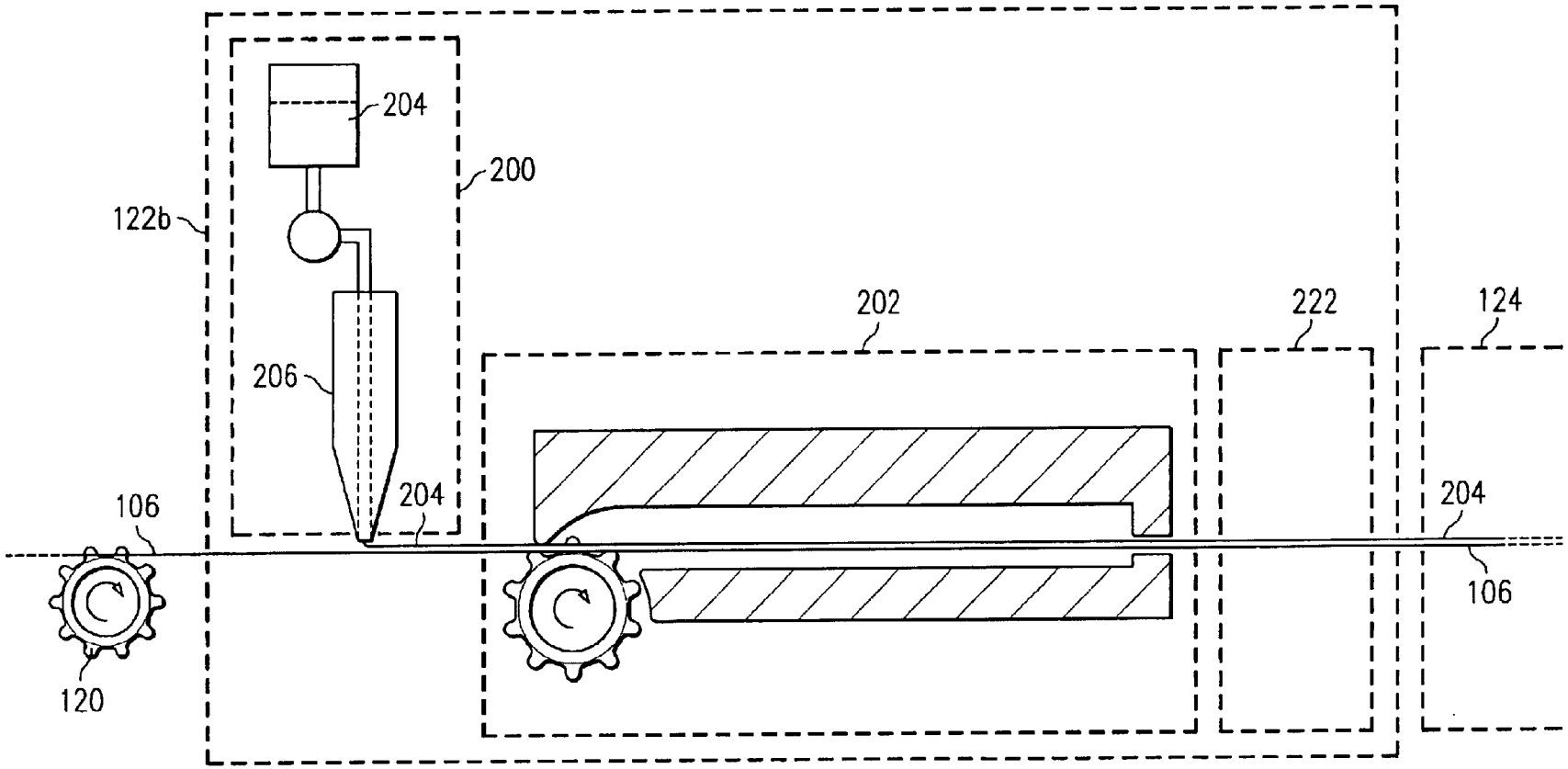
FIG. 2B is a schematic diagram illustrating another embodiment of the development system shown in FIG. 1.
Figures 1, 2B:
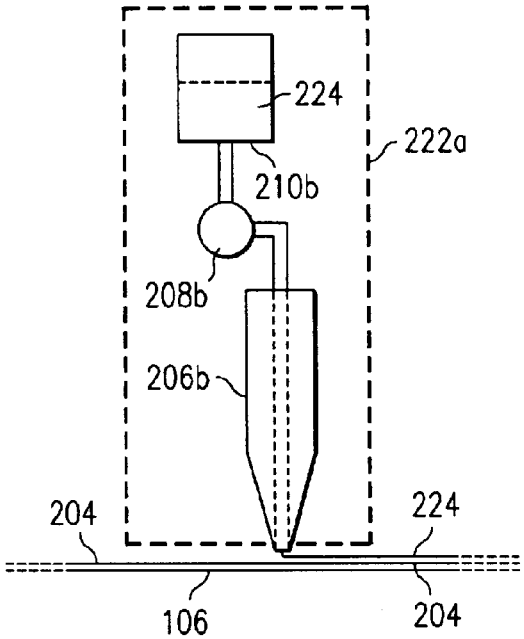

FIG. 2B illustrates an alternative development system 122*b*. In this embodiment, the development system 122*b* comprises an applicator station 200, a development station 202, and a halt station 222. The developer applicator station 200 and the development station 202 were previously discussed in connection with FIG. 2A. The applicator station 200 again applies the developer solution 204 to the film 106 that develops the film 106. The development station 202 maintains a controlled environment around the film 106 during development of the film 106. Halt station 222 operates to retard or substantially stop the continued development of the film 106. Retarding or substantially stopping the continued development of the film 106 increases the amount of time the film 106 can be exposed to visible light without fogging of the film 106. As discussed in greater detail below, the film 106 may be scanned using visible light, and increasing the time the film 106 can be scanned without negatively affecting the film 106 may be advantageous in some embodiments of the improved film processing system 100. FIGS. 2B-1–2B4 illustrate different examples of the halt station 222.

FIG. 2B-1 illustrates a halt station 222*a* that operates to apply at least one halt solution 224 to the film 106 coated with processing solution 204. The halt solution 224 retards or substantially stops the continued development of the film 106. In the embodiment illustrated, the halt station 222*a* comprises an applicator 206*b*, a fluid delivery system 208*b*, and a reservoir 210*b*, similar in function and design as described in FIG. 2A. Although a single applicator 206*b*, fluid delivery system 208*b*, and reservoir 210*b* are illustrated, the halt station 222*a* may comprise any number of applicators 206*b*, fluid delivery systems 208*b*, and reservoirs 210*b* that apply other suitable halt solutions 224 and other suitable solutions.

In one embodiment, the halt solution 224 comprises a bleach solution. In this embodiment, the bleach solution substantially oxidizes the metallic silver grains forming the silver image into a silver compound, which may improve the transmission of light through the film 106 during the scanning operation. In another embodiment, the halt solution 224 comprises a fixer solution. In this embodiment, the fixer solution substantially dissolves the undeveloped or unused silver halide, which can also improve the transmission of light through the film 106. In yet another embodiment, multiple halt solutions 224 are applied to the film 106. For example, a fixer solution can be applied to the film 106 and then a stabilizer solution can be applied to the film 106. In this example, the addition of the stabilizer desensitizes the silver halide within the film 106 and may allow the film 106 to be stored for long periods of time without sensitivity to light. In order to apply multiple halt solutions, the halt station 222*a* may include multiple applicators 206*b* to apply the different halt solutions 224 to the film 106. Alternatively, a single applicator capable of applying multiple layers of processing solution to the film may be employed. The halt solution 224 may comprise any other suitable processing solution. For example, the halt solution 224 may comprise water, a blix solution , a stop solution, or any other suitable solution or combination of processing solutions for retarding or substantially stopping the continued development of the film 106.

Figures 2, 2B:
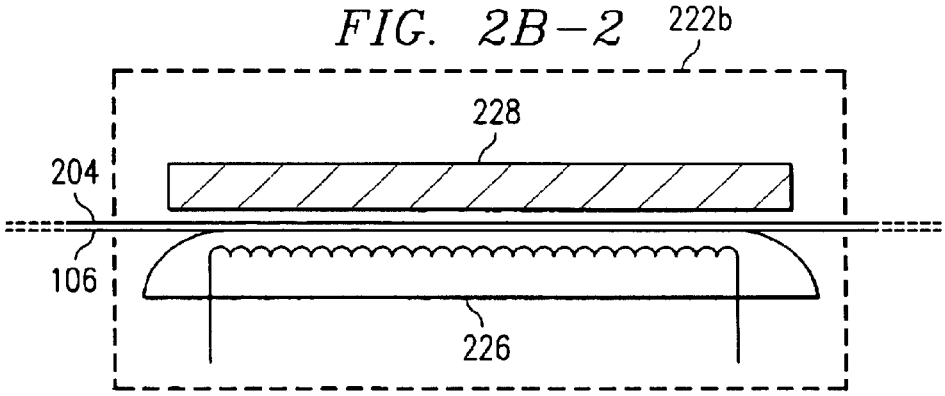

FIG. 2B-2 illustrates a halt station 222*b* that operates to chill the developing film 106. Chilling the developing film 106 substantially slows the chemical developing action of the processing solution 204. In the embodiment illustrated, the chill station 222*b* comprises an electrical cooling plate 226 and insulation shield 228. In this embodiment, the cooling plate 226 is electronically maintained at a cool temperature that substantially arrests the chemical reaction of the processing solution 204. The insulation shield 228 substantially reduces the heat transfer to the cooling plate 226. The chill halt station 222*b* may comprise any other suitable system and device for chilling the developing film 106.

Figures 2, 2B, 3:
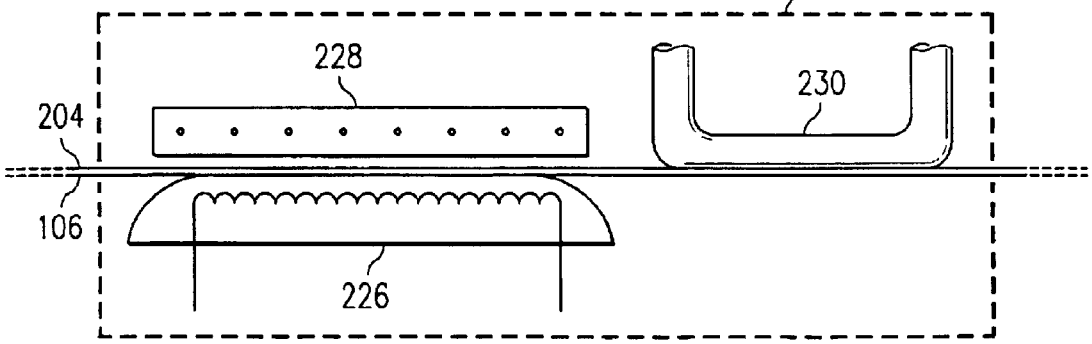
Figures 2, 2B, 3, 4:
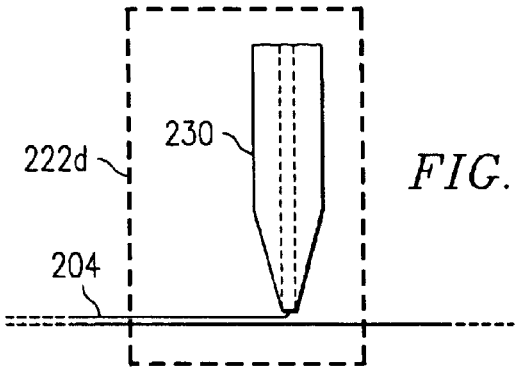
Figure 3:
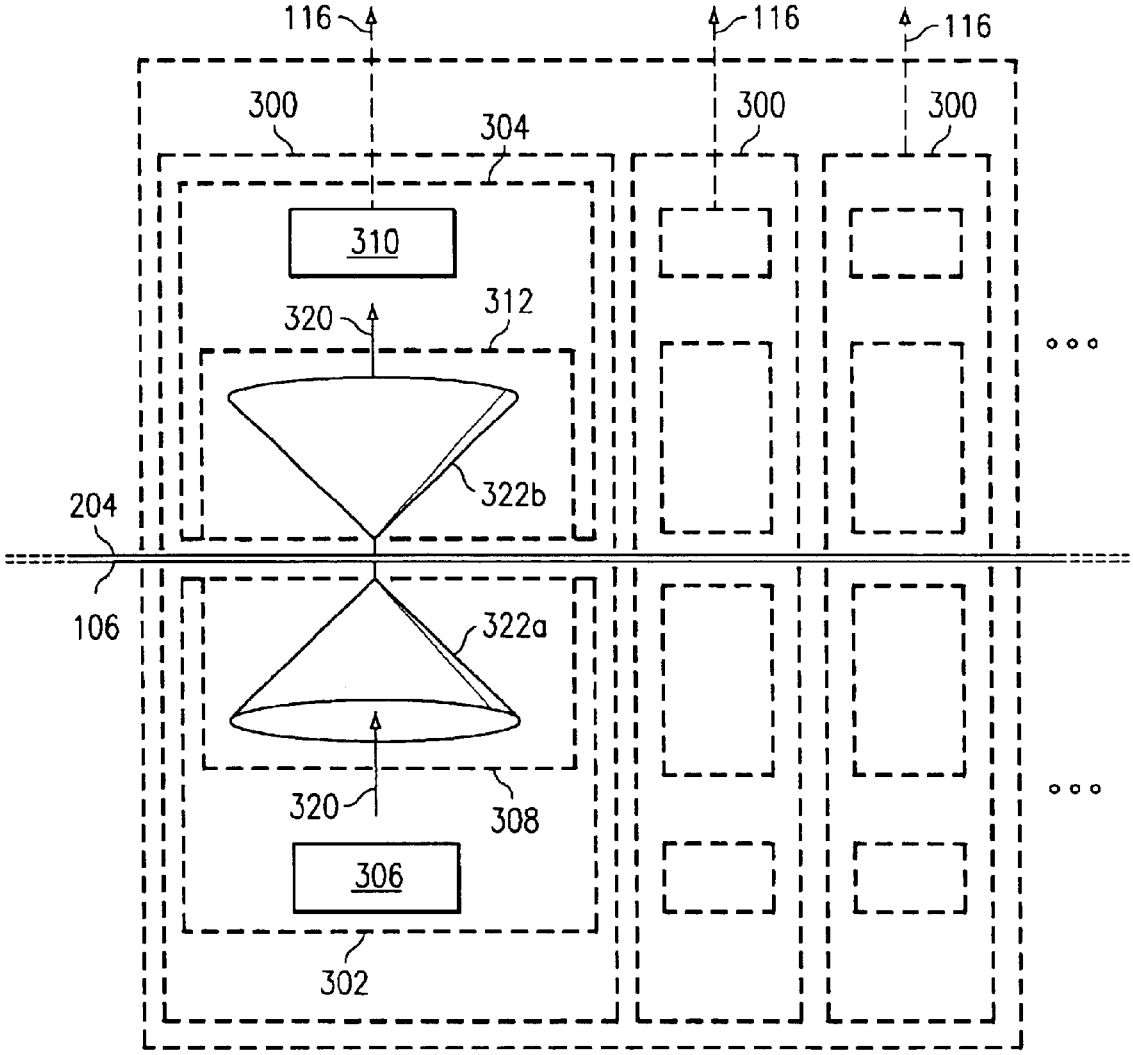

FIG. 2B-3 illustrates a halt station 222*c* that operates to dry the processing solution 204 on the coated film 106. Drying the processing solution 204 substantially stops further development of the film 106. In the embodiment illustrated, the halt station 222*c* comprises an optional cooling plate 226, as described in FIG. 2B-2, and a drying system 228. Although heating the coated film 106 would facilitate drying the processing solution 204, the higher temperature would also have the effect of accelerating the chemical reaction of the processing solution 204 and film 106. Accordingly, in the preferred embodiment, the film 106 is cooled to retard the chemical action of the processing solution 204 and then dried to effectively freeze-dry the coated film 106. Although chilling the film 106 is preferred, heating the film 106 to dry the film 106 can also be accomplished by incorporating the accelerated action of the heated developer solution 204 into the development time for the film 106. In another embodiment in which a suitable halt solution 224 is applied to the film 106, the chemical action of the processing solution 204 is already minimized and the film 106 can be dried using heat without substantially effecting the development of the film 106. As illustrated, the drying system 228 circulates air over the film 106 to dry the processing solution 204 and depending upon the embodiment, the halt solution 224. The halt station 222*c* may comprise any other suitable system for drying the film 106.

FIG. 2B-4 illustrates a halt station 222*d* that operates to substantially remove excess processing solution 204, and any excess halt solution 224, from the film 106. The halt station 222*d* does not remove the solutions 204, 224 that are absorbed into the film 106. In other words, even after the wiping action, the film 106 includes some solution 204, 224. Removing any excess processing solution 204 will retard the continued development of the film 106. In addition, wiping any excess solutions 204, 224 from the film 106 may improve the light reflectance and transmissivity properties of the coated film 106. In particular, removal of the excess solutions 204, 224 may reduce any surface irregularities in the coating surface, which can degrade the scanning operations described in detail in FIGS. 3 and 4. In the embodiment illustrated, the halt station 222*d* comprises a wiper 230 operable to substantially remove excess processing solution 204 and any halt solution 224. In a particular embodiment, the wiper 230 includes an absorbent material that wicks away the excess solutions 204, 224. In another embodiment, the wiper 230 comprises a squeegee that mechanically removes the substantially all the excess solutions 204, 224. The halt station 222*d* may comprise any suitable device or system operable to substantially remove any excess solutions 204, 224.

Although specific embodiments of the halt station 222 have been described above, the halt station 222 may comprise any suitable device or system for retarding or substantially stopping the continued development of the film 106. In particular, the halt station 222 may comprise any suitable combination of the above embodiments. For example, the halt station 222 may comprise an applicator 206*b* for applying a halt solution 224, a cooling plate 226, and a drying system 228. As another example, the halt station 222 may comprise a wiper 230 and a drying system 228.

FIG. 3 is a diagram of the scanning system 124. Scanning system 124 comprises one or more scanning stations 300. Individual scanning stations 300 may have the same or different architectures and embodiments. Each scanning station 300 comprises a lighting system 302 and a sensor system 304. The lighting system 302 includes one or more light sources 306 and optional optics 308. The sensor system 304 includes one or more detectors 310 and optional optics 312. In operation, the lighting system 302 operates to produce suitable light 320 that is directed onto the film 106. The sensor system 304 operates to measure the light 320 from the film 106 and produce sensor data 116 that is communicated to the to the data processing system 102.

Each scanning station 300 utilizes electromagnetic radiation, i.e., light, to scan the film 106. Individual scanning stations 300 may have different architectures and scan the film 106 using different colors, or frequency bands (wavelengths), and color combinations. In particular, different colors of light interact differently with the film 106. Visible light interacts with the dye image and silver within the film 106. Whereas, infrared light interacts with any elemental silver and/or silver halide, but the dye image is generally transparent to infrared light. The term "color" is used to generally describe specific frequency bands of electromagnetic radiation, including visible and non-visible light.

Visible light, as used herein, means electromagnetic radiation having a wavelength band generally between about 400 nm and about 700 nm. Visible light can be separated into specific bandwidths. For example, the color red is generally associated with light within a frequency band of approximately 600 nm to 700 nm, the color green is generally associated with light within a frequency band of approximately 500 nm to 600 nm, and the color blue is generally associated with light having a wavelength of approximately 400 nm to 500 nm. Near infrared light is generally associated with radiation having a wavelength of approximately 700 nm to 1500 nm. Although specific colors and wavelengths are described herein, the scanning station 300 may utilize other suitable colors and wavelengths (frequency) ranges without departing from the spirit and scope of the invention.

The light source 306 may comprise one or more devices or a system that produces suitable light 320. In the preferred embodiment, the light source 306 comprises an array of light-emitting diodes (LEDs). In this embodiment, different LEDs within the array may be used to produce different colors of light 320, including infrared light. In particular, specific colors of LEDs can be controlled to produce short duration pulses of light 320. In another embodiment, the light source 306 comprises a broad spectrum light source 306, such as a Xenon, fluorescent, incandescent, tungsten-halogen, direct gas discharge lamps, and the like. In this embodiment, the sensor system 304 may include filters for spectrally separating the colors of light 320 from the film 106. For example, as described below, a RGB filtered trilinear array of detectors may be used to spectrally separate the light 320 from the film 106. In another embodiment of a broad-spectrum light source, the light source 306 includes a filter, such as a color wheel, to produce the specified colors of light 320. In another embodiment, the light is filtered into specific bands after the light has interacted with the film 106. For example, a hot or cold mirror can be used to separate the infrared light from the visible light. The visible light can then be separated into its constituent colors to produce sensor data 116. In yet another embodiment, the light source 306 comprises a point light source, such as a laser. For example, the point light source may be a gallium arsenide or an indium gallium phosphide laser. In this embodiment, the width of the laser beam is preferably the same size as a pixel on the film 106 (~12 microns). Filters, such as a color wheel, or other suitable wavelength modifiers or limiters maybe used to provide the specified color or colors of light 320.

Optional optics 308 for the lighting system 302 directs the light 320 to the film 106. In the preferred embodiment, the optics 308 comprises a waveguide that directs the light 320 onto the film 106. In another embodiment, the optics 320 includes a lens system for focusing the light 320. In a particular embodiment, the lens system includes a polarizing filter to condition the light 320. The optics 308 may also include a light baffle 322*a*. The light baffle 322*a* constrains illumination of the light 320 within a scan area in order to reduce light leakage that could cause fogging of the film 106. In one embodiment, the light baffle 322*a* comprises a coated member adjacent the film 106. The coating is generally a light absorbing material to prevent reflecting light 320 that could cause fogging of the film 106.

The detector 310 comprises one or more photodetectors that convert light 320 from the film 106 into data signals 116. In the preferred embodiment, the detector 310 comprises a linear charge coupled device (CCD) array. In another embodiment, the detector 310 comprises an area array. The detector 310 may also comprise a photodiode, phototransistor, photoresistor, and the like. The detector 310 may include filters to limit the bandwidth, or color, detected by individual photodetectors. For example, a trilinear array often includes separate lines of photodetectors with each line of photodetectors having a color filter to allow only one color of light to be measured by the photodetector. Specifically, in a trilinear array, the array generally includes individual red, green, and blue filters over separate lines in the array. This allows the simultaneous measurement of red, green, and blue components of the light 320. Other suitable types of filters may be used. For example, a hot mirror and a cold mirror can be used to separate infrared light from visible light.

Optional optics 312 for the sensor system 304 directs the light 320 from the film 106 onto the detector 310. In the preferred embodiment, the optics 312 comprises lens system that directs the light 320 from the film 106 onto the detector 310. In a particular embodiment, the optics 312 include polarized lenses. The optics 312 may also include a light baffle 322*b*. The light baffle 322*b* is similar in function to light baffle 322*a* to help prevent fogging of the film 106.

As discussed previously, individual scanning stations 300 may have different architectures. For example, light 320 sensed by the sensor system 304 maybe transmitted light or reflected light. Light 320 reflected from the film 106 is generally representative of the emulsion layer on the same side of the film 106 as the sensor system 304. Specifically, light 320 reflected from the front side (emulsion side) of the film 106 represents the blue sensitive layer and light 320 reflected from the back side of the film 106 represents the red sensitive layer. Light 320 transmitted through the film 106 collects information from all layers of the film 106. Different colors of light 320 are used to measure different characteristics of the film 106. For example, visible light interacts with the dye image and silver within the film 106, and infrared light interacts with the silver in the film 106.

Different architectures and embodiments of the scanning station 300 may scan the film 106 differently. In particular, the lighting system 302 and sensor system 304 operate in concert to illuminate and sense the light 320 from the film 106 to produce suitable sensor data 116. In one embodiment, the lighting system 302 separately applies distinct colors of light 320 to the film 106. In this embodiment, the sensor system 304 generally comprises a non-filtered detector 310 that measures in series the corresponding colors of light 320 from the film 106. In another embodiment, multiple unique color combinations are simultaneously applied to the film 106, and individual color records are derived from the sensor data 116. In another embodiment, the lighting system 302 simultaneously applies multiple colors of light 320 to the film 106. In this embodiment, the sensor system 304 generally comprises a filtered detector 310 that allows the simultaneous measurement of individual colors of light 320. Other suitable scanning methods may be used to obtain the required color records.

The use of the halt station 222 may improve the scanning properties of the film 106 in addition to retarding or substantially stopping the continued development of the film 106. For example, the intensity of light 320 transmitted through the film 106 maybe partially blocked, or occluded, by the silver within the film 106. In particular, both the silver image and silver halide within the film 106 occlude light 320. On the whole, the silver image within the film 106 absorbs light 320, and the silver halide reflects light 320. The halt solutions 224 may be used to improve the scanning properties of the film 106. For example, applying a bleach solution to the film 106 reduces the optical density of the silver image within the film 106. Applying a fixer solution to the film 106 reduces optical density of silver halide within the film 106. Another method for improving the scanning properties of the film 106 is drying the film 106. Drying the film 106 improves the clarity of the film 106.

As described above, the scanning system 124 may include one or more individual scanning stations 300. Specific examples of scanner station 300 architectures are illustrated in FIGS. 4A–4D. The scanning system 124 may comprise any illustrated example, combination of examples, or other suitable method or system for scanning the film 106.

Figure 4A:
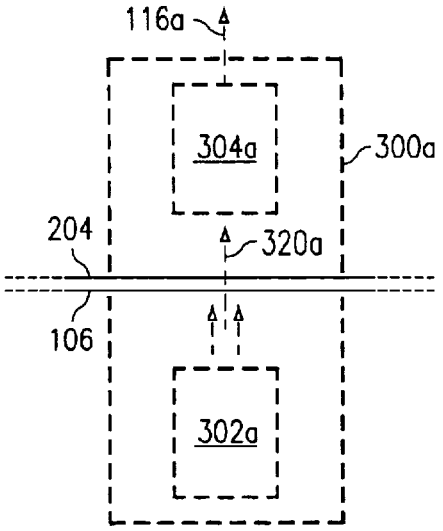
FIGS. 4A–4D are schematic diagrams illustrating various embodiments of a scanning station shown in FIG. 3.

FIG. 4A is a schematic diagram illustrating a scanning station 300*a* having a transmission architecture. As illustrated, the transmission scanning station 300*a* comprises a lighting system 302*a* and a sensor system 304*a*. Lighting system 302*a* produces light 320*a* that is transmitted through the film 106 and measured by the sensor system 304*a*. The sensor system 304*a* produces sensor data 116*a* that is communicated to the data processing system 102. Lighting system 302*a* and sensor system 304*a* are similar in design and function as lighting system 302 and sensor system 304, respectively. Although FIG. 4A illustrates the light 320*a* being transmitted through the film 106 from the backside to the frontside of the film 106, the light 320*a* can also be transmitted through the film 106 from the frontside to the backside of the film 106 without departing from the scope of the invention.

In one embodiment of the scanning station 300*a*, the light 320*a* produced by the lighting system 302*a* comprises visible light. The visible light 320*a* may comprise broadband visible light, individual visible light colors, or combinations of visible light colors. The visible light 320*a* interacts with any elemental silver and/or silver halide and at least one dye cloud within the film 106.

In an embodiment in which the visible light 320*a* interacts with the magenta, cyan and yellow dye images within the film 106, as well as elemental silver and/or silver halide within the film 106, the sensor system 304*a* records the intensity of visible light 320*a* from the film 106 and produces sensor data 116*a*. The sensor data 116*a* generally comprises a red, green, and blue record corresponding to the magenta, cyan, and yellow dye images. Each of the red, green, and blue records includes a silver record. As previously discussed, the elemental silver and/or silver halide partially blocks the visible light 320*a* being transmitted through the film 106. Accordingly, the red, green, and blue records are generally processed by the data processing system 102 to correct the records for the blockage caused by the elemental silver and/or silver halide in the film 106.

In another embodiment of the transmission scanning station 300*a*, the light 320*a* produced by the lighting system 302*a* comprises visible light and infrared light. As discussed above, the visible light may comprise broadband visible light, individual visible light colors, or combinations of visible light colors. The infrared light may comprise infrared, near infrared, or any suitable combination. The visible light 320*a* interacts with the elemental silver and/or silver halide and at least one dye image, i.e. cyan, magenta, or yellow dye images, within the film 106 to produce a red, green, and blue record that includes a silver record. The infrared light interacts with the elemental silver and/or silver halide within the film 106 and produces a silver record. The silver image record can then be used to remove, at least in part, the silver metal record contained in the red, green, and blue records. In this embodiment, the silver is analogous to a defect that obstructs the optical path of the infrared light. The amount of blockage is used as a basis for modifying the color records. For example, in pixels having a high silver density, the individual color records are significantly increased, whereas in pixels having a low silver density, the individual color records are relatively unchanged.

In yet another embodiment of the transmission scanning station 300*a*, the light produced by the lighting system 302*a* comprises infrared or near infrared light. In this embodiment, the infrared light 320*a* interacts with the silver record in the film 106 but does not substantially interact with the dye images within the film 106. In this embodiment, the sensor data 116*a* does not spectrally distinguish the magenta, cyan, and yellow dye images. An advantage of this embodiment is that the infrared light 320*a* does not fog the film 106. In a particular embodiment, the advantage of not fogging the film 106 allows the film 106 to be scanned at multiple development times without negatively affecting the film 106. In this embodiment, the scanning station 300*a* can be used to determine the optimal development time for the film 106. This embodiment may optimally be used to determine the optimal development time of the film 106, which can then be scanned using another scanning station 300

Figure 4B:
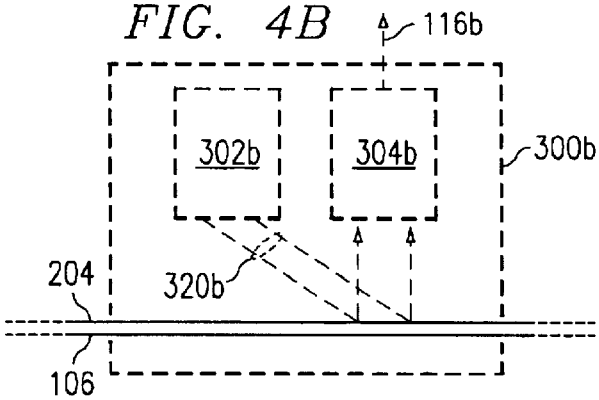

FIG. 4B is a schematic diagram illustrating a scanning station 300*b* having a reflection architecture. The reflective scanning station 300*b* comprises a lighting system 302*b* and a sensor system 304*b*. Lighting system 302*b* produces light 320*b* that is reflected from the film 106 and measured by the sensor system 304*b*. The sensor system 304*b* produces sensor data 116*b* that is communicated to the data processing system 102. Lighting system 302*b* and sensor system 304*b* are similar to lighting system 302 and sensor system 304, respectively.

In one embodiment of the reflective scanning station 300*b* used to scan the blue emulsion layer of the film 106, the light 320*b* produced by the lighting system 302*b* comprises blue light. In this embodiment, the blue light 320*b* scans the elemental silver and/or silver halide and dye image within the blue layer of the film 106. The blue light 320*b* interacts with the yellow dye image and also the elemental silver and/or silver halide in the blue emulsion layer. In particular, the blue light 320*b* is reflected from the silver halide and measured by the sensor system 304*b* to produce a blue record. Many conventional films 106 include a yellow filter below the blue emulsion layer that blocks the blue light 320*a* from illuminating the other emulsion layers of the film 106. As a result, noise created by cross-talk between the blue emulsion layer and the red and green emulsion layers is substantially reduced.

In another embodiment of the reflective scanning station 300*b* used to scan the blue emulsion layer of the film 106, the light 320*b* produced by the lighting system 302*b* comprises non-blue light. It has been determined that visible light other than blue light interacts in substantially the same manner with the various emulsion layers. In this embodiment, infrared light also interacts in substantially the same manner as non-blue light, with the exception that infrared light will not fog the emulsion layers of the film 106. In this embodiment, the non-blue light 320*b* interacts with the elemental silver and/or silver halide in the blue emulsion layer of the film 106, but is transparent to the yellow dye within the blue emulsion layer of the film 106. This embodiment is prone to higher noise levels created by cross-talk between the blue and green emulsion layers of the film 106.

In yet another embodiment of the reflective scanning station 300*b*, the light 320*b* produced by the lighting system 302*b* comprises visible and infrared light. In this embodiment, blue light interacts with the yellow dye image and the elemental silver and/or silver halide in the blue emulsion layer, green light interacts with magenta dye image and the silver in the green emulsion layer, red light interacts with the cyan dye image and the silver in the red emulsion layer, and the infrared light interacts with the silver in each emulsion layer of the film 106. In this embodiment, the sensor system 304*b* generally comprises a filtered detector 310*b* (not expressly shown) that measures the red, green, blue, and infrared light 320*b* from the film 106 to produce red, green, blue, and infrared records as sensor data 116*b*.

Although the scanning station 300*b* is illustrated with the sensor system 304*b* located on front side of the film 106, the sensor system 304*b* may also be located on the back side of the film 106. In one embodiment, the light 320*b* produced by the lighting system 302*b* may comprise red light. The red light largely interacts with the cyan dye image and silver in the red emulsion layer of the film 106 to produce a red record of the sensor data 116*b*.

Figure 4C:
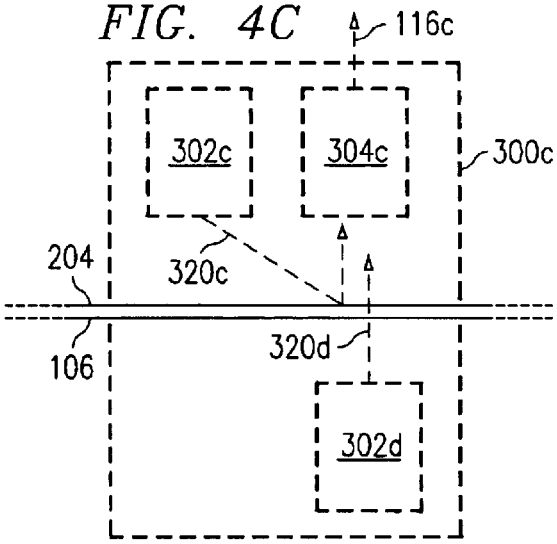

FIG. 4C is a schematic diagram illustrating a scanning station 300*c* having a transmission-reflection architecture. In this embodiment, the scanning station 300*c* comprises a first lighting system 302*c*, a second lighting system 302*d*, and a sensor system 304*c*. In the preferred embodiment, the lighting system 302*c* operates to illuminate the front side of the film 106 with light 320*c*, the second lighting system 302*d* operates to illuminate the backside of the film 106 with light 320*d*, and the sensor system 304*c* operates to measure the light 320*c* reflected from the film 106 and the light 320*d* transmitted through the film 106. Based on the measurements of the light 320*b*, 320*d*, the sensor system 304*c* produces sensor data 116*c* that is communicated to the data processing system 102. Lighting system 302*c* and 302*d* are similar to lighting system 302, and sensor system 304*c* is similar to the sensor system 304. Although scanning station 300*c* is illustrated with lighting systems 302*c*, 302*d*, a single light source may be used to produce light that is directed through a system of mirrors, shutters, filters, and the like, to illuminate the film 106 with the front side of the film 106 with light 320*c* and illuminate the back side of the film 106 with light 320*d*. The light 302*c*, 302*d* may comprise any color or color combinations, including infrared light.

This embodiment of the scanning station 300*c* utilizes many of the positive characteristics of the transmission architecture scanning station 300*a* and the reflection architecture scanning station 300*b*. For example, the blue emulsion layer is viewed better by light 320*c* reflected from the film 106 than by light 320*d* transmitted through the film 106; the green emulsion layer is viewed better by light 320*d* transmitted through the film 106 than by light 320*c* reflected from the film 106; and the red emulsion layer is adequately viewed by light 320*d* transmitted through the film 106. In addition, the cost of the scanning station 300*c* is minimized through the use of a single sensor system 304*c*.

In the preferred embodiment of the scanning station 300*c*, the light 320*c* comprises blue light, and light 320*d* comprises red, green, and infrared light. The blue light 320*c* interacts with the yellow dye image and silver in the blue emulsion layer of the film 106. The sensor system 304*c* measures the light 302*c* from the film 106 and produces a blue-silver record. The red and green light 320*d* interacts with the cyan and magenta dye images, respectively, as well as the silver in the film 106. The infrared light 320*d* interacts with the silver, but does not interact with the dye clouds within the film 106. As discussed previously, the silver contained within the film 106 may comprise silver grains, silver halide, or both. The red, green, and infrared light 320*d* transmitted through the film 106 is measured by the sensor system 304*c*, which produces a red-silver, green-silver, and silver record. The blue-silver, red-silver, green-silver, and silver records form the sensor data 116*c* that is communicated to the data processing system 102. The data processing system 102 utilizes the silver record to facilitate removal of the silver component from the red, green, and blue records.

In another embodiment, the light 320*c* comprises blue light and infrared light, and light 320*d* comprises red, green, and infrared light. As discussed previously, the blue light 320*c* mainly interacts with the yellow dye image and silver within the blue emulsion layer of the film 106. The infrared light 320*c* interacts with mainly the silver in the blue emulsion layer of the film 106. The sensor system 304*c* measures the blue and infrared light 320*c* from the film 106 and produces a blue-silver record and a front side silver record, respectively. The red, green, and infrared light 320*d* interact with the film 106 and are measured by the sensor system 304*c* to produce red-silver, green-silver and transmitted-silver records as discussed above. The blue-silver, red-silver, green-silver, and both silver records form the sensor data 116*c* that is communicated to the data processing system 102. In this embodiment, the data processing system 102 utilizes the front side silver record of the blue emulsion layer to facilitate removal of the silver component from the blue-silver record, and the transmission-silver record is utilized to facilitate removal of the silver component from the red and green records.

Although the scanning station 300*c* is described in terms of specific colors and color combinations of light 320*c* and light 320*d*, the light 320*c* and light 320*d* may comprise other suitable colors and color combinations of light without departing from the scope of the invention. For example, light 320*c* may comprise non-blue light, infrared light, broadband white light, or any other suitable light. Likewise, light 320*d* may include blue light, broadband white light, or another other suitable light. Scanning station 300*c* may also comprise other suitable embodiments without departing from the scope of the invention. For example, although the scanning station 300*c* is illustrated with two lighting systems 302 and a single sensor system 304, the scanning station 300*c* could be configured with a single lighting system 302 and two sensor systems 304, wherein one sensor system measures light 320 reflected from the film 106 and the second sensory system 304 measures light 320 transmitted through the film 106. In addition, as discussed above, the scanning station 300 may comprise a single lighting system that illuminates the film 106 with light 320*c* and light 320*d*.

Figure 4D:
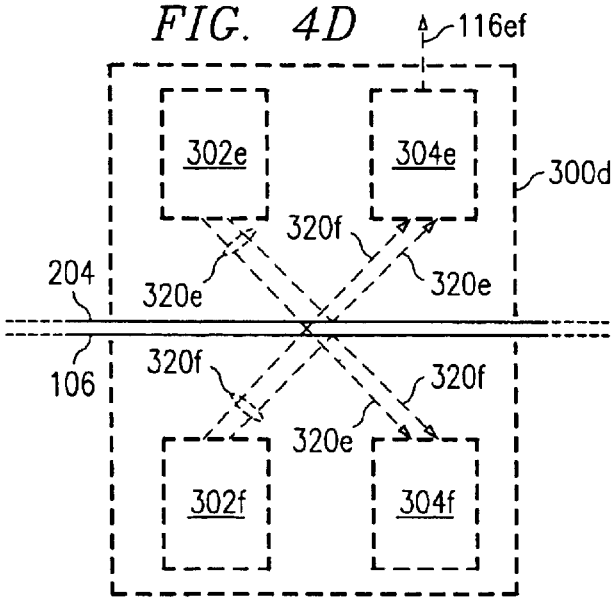

FIG. 4D is a schematic diagram illustrating a scanning station 300*d* having a reflection-transmission-reflection architecture. In this embodiment, the scanning station 300*d* comprises a first lighting system 302*e*, a second lighting system 302*f*, a first sensor system 304*e*, and a second sensor system 304*f*. In the embodiment illustrated, the lighting system 302*e* operates to illuminate the front side of the film 106 with light 320*e*, the second lighting system 302*f* operates to illuminate the back side of the film 106 with light 320*f*, the first sensor system 304*e* operates to measure the light 320*e* reflected from the film 106 and the light 320*f* transmitted through the film 106, and the second sensor system 304*f* operates to measure the light 320*f* reflected from the film 106 and the light 320*e* transmitted through the film 106. Based on the measurements of the light 320*e* and 320*f*, the sensor systems 304*e*, 304*f* produce sensor data 116*ef* that is communicated to the data processing system 102. Lighting systems 302*e*, 302*f* are similar to lighting systems 302, and sensor systems 304*e*, 304*f* are similar to the sensor system 304. Although scanning station 300*d* is illustrated with lighting systems 302*e*, 302*f*, and sensor systems 304*e*, 304*f*, a single lighting system and/or sensory system, respectively, may be used to produce light that is directed through a system of mirrors, shutters, filters, and the like, to illuminate the film 106 with the frontside of the film 106 with light 320*e* and illuminate the backside of the film 106 with light 320*f*.

This embodiment of the scanning station 300*d* expands upon the positive characteristics of the transmission-reflection architecture of scanning station 300*c*. For example, as discussed in reference to FIG. 4C, the blue emulsion layer is viewed better by light 320*e* reflected from the film 106 and the green emulsion layer is viewed better by light 320*e* or 320*f* transmitted through the film 106. Second scanning station 300*f* allows viewing of the red emulsion layer by light 320*f* reflected from the film 106, which generally produces better results than viewing the red emulsion layer by light 320*e* or light 320*f* transmitted through the film 106.

In the preferred embodiment of the scanning station 300*d*, the sensor systems 304*e*, 304*f* include a trilinear array of filtered detectors, and the light 320*e* and the light 320*f* comprises broadband white light and infrared light. The trilinear array operates to simultaneously measure the individual red, green, and blue components of the broadband white light 320*e*, 320*f*. The infrared light is measured separately and can be measured through each filtered detector 310 of the sensor systems 304*e*, 304*f*. The broadband white light 320*e*, 320*f* interacts with the silver and magenta, cyan, and yellow color dyes in the film 106, respectively, and the infrared light 320*e*, 320*f* interacts with the silver within the film 106. The first sensor system 304*e* measures the light 320*e* reflected from the front side of the film 106 and the light 320*f* transmitted through the film 106, and the second sensor system 304*f* measures the light 320*f* reflected from the back side of the film 106 and the light 320*e* transmitted through the film 106. The reflected white light 320*e* measured by the first sensor system 304*e* includes information corresponding to the yellow dye image and the silver in the blue emulsion layer of the film 106. In particular, the blue component of the broadband white light 320*e* measured by the blue detector of the sensor system 304*e* corresponds to the yellow dye image, and the non-blue components of the broadband white light 320*e* measured by the red and green detectors corresponds to the silver within the blue emulsion layer of the film 106. Similarly, the red component of the broadband white light 320*f* measured by the red detector of the sensor system 304*f* corresponds to the cyan dye image, and the non-red components of the broadband white light 320*e* measured by the blue and green detectors corresponds to the silver within the red emulsion layer of the film 106. The white light 320*e*, 320*f* transmitted through the film 106 interacts with each color dye image within the film 106 and the red, green, and blue light components are measured by the red, green, and blue detectors of the sensor systems 304*e*, 304*f* to produce individual red, green and blue light records that include the silver. The infrared light 320*e* reflected from the film 106 and measured by the sensor system 304*e* corresponds to the silver in the blue emulsion layer of the film 106, and the infrared light 320*f* reflected from the film 106 and measured by the sensor system 304*f* corresponds to the silver in the red emulsion layer of the film 106. The infrared light 320*e*, 320*f* transmitted through the film 106 measured by the sensor systems 304*e*, 304*f* corresponds to the silver in the red, green, and blue emulsion layers of the film 106. The individual measurements of the sensor systems 304*e*, 304*f* are communicated to the data processing system 102 as sensor data 116*d*. The data processing system 102 processes the sensor data 116*d* and constructs the digital image 108 using the various sensor system measurements. For example, the blue signal value for each pixel can be calculated using the blue detector data from the reflected light 320*e* and the blue detector data from the transmitted light

320*f*, as modified by non-blue detector data from the reflected light 320*e*, the infrared data from the reflected light 320*e* and the non-blue detector data from the transmitted light 320*f*. The red and green signal values for each pixel can be similarly calculated using the various measurements.

In another embodiment of the scanning station 300*d*, the sensor systems 304*e*, 304*f* include a trilinear array of filtered detectors, and the light 320*e* and the light 320*f* comprises broadband white light. This embodiment of the scanning station 300*d* operates in a similar manner as discussed above, with the exception that infrared light is not measured or used to calculate the digital image 108. Although the scanning station 300*d* is described in terms of a specific colors and color combinations of light 320*e* and light 320*f*, the light 320*e* and light 320*f* may comprise other suitable colors and color combinations of light without departing from the scope of the invention. Likewise, the scanning station 300*d* may comprise other suitable devices and systems without departing from the scope of the invention.

Figure 5A:
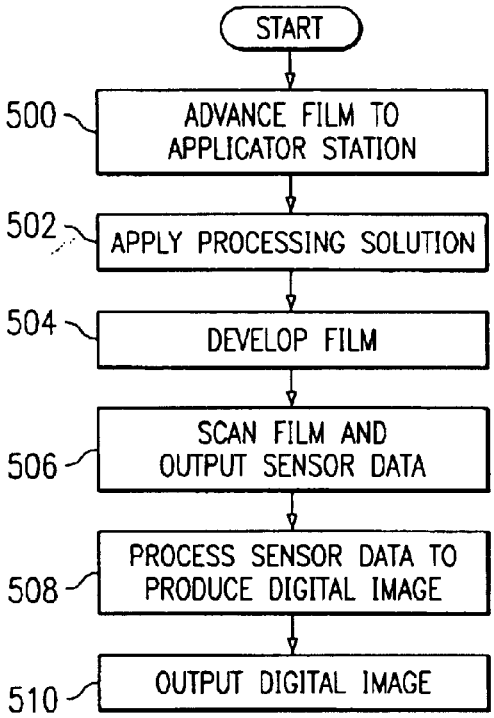
FIGS. 5A–5B are flow charts illustrating various methods of digital color dye film processing in accordance with the invention.

FIG. 5A is a flowchart of one embodiment of a method for developing and processing film. This method may be used in conjunction with one or more embodiments of the improved film processing system 100 that includes a data processing system 102 and a film processing system 104 having a transport system 120, a development system 122, and a scanning system 124. The development system 122 includes an applicator station 200 for applying a processing solution 204 to the film 106 and a development station 202. The scanning system 124 comprises a single scanning station 300 operable to scan the film 106 with light 320 having a frequency within the visible light spectrum and produce sensor data 116 that is communicated to the data processing system 102. The data processing system 102 processes the sensor data 116 to produce a digital image 108 that may be output to an output device 110.

The method begins at step 500, where the transport system 120 advances the film 106 to the applicator station 200. Film 106 is generally fed from a conventional film cartridge and advanced by the transport system 120 through the various stations of the film processing system 104. At step 502, processing solution 204 is applied to the film 106. The processing solution 204 initiates production of silver and at least one dye image within the film 106. The processing solution 204 is generally applied as a thin coating onto the film 106, which is absorbed by the film 106. At step 504, the film 106 is advanced through the development station 202 where the dye images and silver grains develop within the film 106. The environmental conditions, such as the temperature and humidity, are controlled within the development station 202. This allows the film 106 to develop in a controlled and repeatable manner and provides the proper development time for the film 106. At step 506, the film 106 is scanned by the scanning system 124. The light interacts with the film 106 and is sensed by sensor system 304. As discussed in reference to FIGS. 4A–4D, the film 106 can be scanned in a number of different ways embodied in a number of different architectures, each with their own advantages. Sensor data 116 is produced by the scanning system 124 and communicated the data processing system 102. At step 508, the sensor data 116 is processed to produce the digital image 108. The data processing system 102 includes image processing software 114 that processes the sensor data 116 to produce the digital image 108. The digital image 108 represents the photographic image recorded on the film 106. At step 510, the digital image 108 is output to one or more output devices 110, such as monitor 110*a*, printer 110*b*, network system 110*c*, storage device 110*d*, computer system 110*e*, and the like.

Figure 5B:
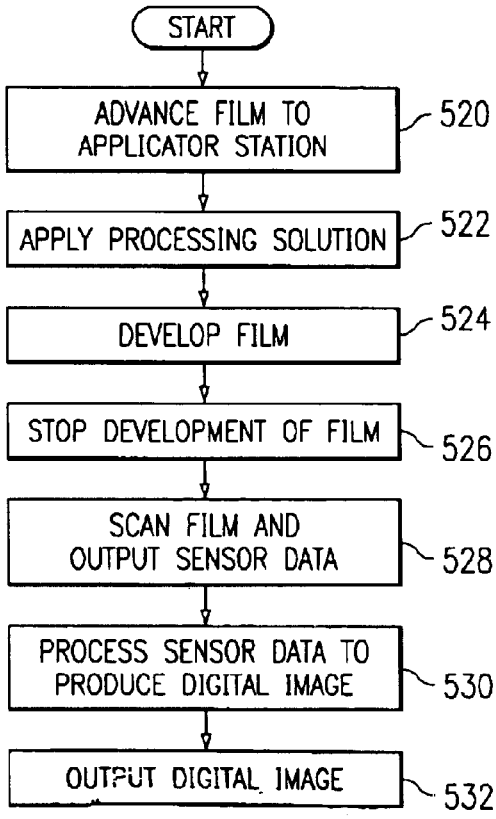

FIG. 5B is a flowchart of another embodiment of a method for developing and processing film. This method may be used with one or more embodiments of the improved film processing system 100 that includes the development system 122 having the halt station 222. This method is similar to the method described in FIG. 5A, with the exception that development of the film 106 is substantially stopped by the halt station 222.

The method begins at step 520, where the transport system 120 advances the film 106 to the applicator station 200. At step 522, processing solution 204 is applied to the film 106. The processing solution 204 initiates production of elemental silver grains and at least one dye image within the film 106. At step 524, the film 106 is advanced through the development station 202 where the film 106 is developed. At step 526, the continued development of the film 106 is retarded or substantially stopped by the halt station 222. Retarding or substantially stopping the continued development of the film 106 allows the film 106 to be scanned using visible light 320 without fogging the film 106 during the scanning process. For example, if the development of the film 106 is stopped, the film 106 can be exposed to visible light without negatively affecting the scanning process. The halt station 222 may comprise a number of embodiments. For example, the halt station 222 may apply a halt solution 232, such as a bleach solution, fixer solution, blix solution, stop solution and the like. The halt solution 232 may also operate to stabilize the film 106. The halt station 222 may also comprise a wiper, drying system, cooling system and the like. At step 528, the film 106 is scanned by the scanning system 124 using light 320 having at least one frequency within the visible portion of the electromagnetic spectrum, i.e., visible light. At step 530, the sensor data 116 is processed to produce the digital image 108. At step 532, the digital image 108 is output to one or more output devices 110, such as monitor 110*a*, printer 110*b*, network system 110*c*, storage device 110*d*, computer system 110*e*, and the like.

While the invention has been particularly shown and described in the foregoing detailed description, it will be understood by those skilled in the art that various other changes in form and detail may be made without departing from the spirit and scope of the invention.

What is claimed is:

1. An aqueous developer solution for use in digital film processing, comprising:

a developing agent;

at least one surfactant; and at least one thickener;

wherein said developer solution has a surface tension of less than about 30 dynes/cm and a viscosity of between about 5.000 and about 30.000 cP.

2. The developer solution of claim 1, wherein said surfactant comprises a fluorosurfactant.

3. The developer solution of claim 1, wherein said developer solution comprises a buffered solution having a pH greater than or equal to about 8.

4. The developer solution of claim 3, further comprising at least one activator.

5. The developer solution of claim 3, further comprising at least one restrainer.

6. The developer solution of claim 3, further comprising at least one preservative.

7. The developer solution of claim 3, further comprising at least one antifoggant or accelerator.

8. The developer solution of claim 1, wherein said thickener comprises a solubilized cellulose.

9. The developer solution of claim 1, wherein said developer solution has a surface tension of less than about 25 dynes/cm.

10. The developer solution of claim 1, wherein the viscosity of said developer solution is between about 10,000 and about 20,000 cP.

11. The developer solution of claim 1, wherein said developing agent comprising a color developing agent which reduces exposed silver halide grains in photographic film to metallic silver, and reacts with one or more dye precursors in photographic film to form a dye image.

12. The developer solution of claim 11, further comprising a developing agent which is not a color developing agent.

13. The developer solution of claim 1, wherein said developer solution comprises a non-Newtonian fluid.

14. A method of processing a photographic film, comprising:

(a) coating an aqueous developer solution containing a developing agent, at least one surfactant, and at least one thickener onto said film, wherein said developer solution has a surface tension of less than about 30 dynes/cm and a viscosity of between about 5,000 and about 30,000 cP, thereby developing said film; and (b) scanning said film through the coating of developer solution.

15. The method of claim 14, wherein said surfactant comprises a fluorosurfactant.

16. The method of claim 14, wherein said developer solution comprises a buffered solution having a pH greater than or equal to about 8.

17. The method of claim 14, wherein said thickener comprises a solubilized cellulose.

18. The method of claim 14, wherein said developer solution has a surface tension of less than about 25 dynes/cm.

19. The method of claim 14, wherein the viscosity of said developer solution is between about 10,000 and about 20,000 cP.

20. The method of claim 14, further comprising the step of coating at least one additional processing solution onto said film.

21. The method of claim 20, wherein said additional processing solution is chosen from the group consisting of: a stop solution, an inhibitor solution, an accelerator solution, a bleach solution, a fixer solution, a blix solution, and a stabilizer solution.

22. The method of claim 21, wherein said additional processing solution is coated onto said film prior to said scanning step.

23. The method of claim 21, wherein said additional processing solution has a surface tension of less than about 30 dynes/cm.

24. The method of claim 21, wherein the viscosity of said additional processing solution is between about 10,000 and about 30,000 cP.

25. A film processing system comprising:

a film loader operable to received exposed film;

an applicator operable to coat 100–10,000 micrometers of a developer solution onto the film, wherein the developer solution includes a developing agents, at least one surfactant, and at least one thickener, and has a surface tension of less than about 30 dynes/cm and a viscosity of between about 5,000 and about 30,000 cP; and a scanning system operable to digitize at least one image contained on the film and produce at least one digital image.

26. The film processing system of claim 25, wherein the scanning system operates to digitize at least one image contained on the film through the coating of developer solution.

27. The film processing system of claim 26, wherein the developer solution is a liquid.

28. The film processing system of claim 25, wherein the scanning system operates to digitize at least one image contained on the film with light within at least a portion of the visible portion of the electromagnetic spectrum.

29. The film processing system of claim 28, wherein the scanning system also operates to digitize the at least one image contained on the film with light within the infrared portion of the electromagnetic spectrum.

30. The film processing system of claim 25, further comprising a halt station operable to apply at least one additional processing solution onto the film.

31. The film processing system of claim 30, wherein the at least one additional processing solution is chosen from the group consisting of: a stop solution, an inhibitor solution, an accelerator solution, a bleach solution, a fixer solution, a blix solution, and a stabilizer solution.

32. The film processing system of claim 25, further comprising a development station operable to control the temperature and humidity of the film after the application of the developer solution.

33. The film processing system of claim 25, further comprising a printer operable to print the at least one digital image.

34. The film processing system of claim 33, wherein the printer is an ink jet type of printer.

35. The film processing system of claim 25, further comprising a communication system operable to communicate the at least one digital image over a network.

36. The film processing system of claim 35, wherein the network comprises the Internet.

37. The film processing system of claim 25, further comprising a memory device operable to store the at least one digital image.

38. The film processing system of claim 37, wherein the memory device is chosen from the group consisting of: a CD, a DVD, a removable hard drive; and an optical disk.

39. The film processing system of claim 25, wherein the film processing system is embodied as a self-service kiosk.

40. The film processing system of claim 25, wherein the film processing system is embodied as a photolab.

41. A method for processing film comprising: receiving an exposed film; coating 100–10,000 micrometers of a developer solution onto the film, wherein the developer solution comprises a developing agent, at least one surfactant, and at least one thickener, and has a surface tension of less than about 30 dynes/cm and a viscosity between about 5,000 and about 30,000 cP; illuminating the film with light; measuring a light intensity from the film and producing sensor data; and processing the sensor data to produce at least one digital image.

42. The method of claim 41, wherein the film is illuminated through the coating of developer solution.

43. The method of claim 41, wherein the light is within at least a portion of the visible portion of the electromagnetic spectrum.

44. The method of claim 43, wherein the light is also within the infrared portion of the electromagnetic spectrum.

45. The method of claim 41, further comprising a applying at least one additional processing solution onto the film.

46. The method of claim 45, wherein the at least one additional processing solution is chosen from the group consisting of: a stop solution, an inhibitor solution, an accelerator solution, a bleach solution, a fixer solution, a blix solution, and a stabilizer solution.

47. The method of claim 41, further comprising controlling the temperature and humidity of the film after coating the film with developer solution.

48. The method of claim 41, further comprising printing at least one digital image.

49. The method of claim 41, further comprising communicating the at least one digital image over a network.

50. The method of claim 49, wherein the network comprises the Internet.

51. The method of claim 41, further comprising storing the at least one digital image on a memory device.

52. The method of claim 51, wherein the memory device is chosen from the group consisting of: a CD, a DVD, a removable hard drive; and an optical disk.

* * * * *